US007553054B2

(12) United States Patent
Yagi

(10) Patent No.: US 7,553,054 B2
(45) Date of Patent: Jun. 30, 2009

(54) VEHICULAR LAMP UNIT

(75) Inventor: Takayuki Yagi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 88 days.

(21) Appl. No.: 11/755,799

(22) Filed: May 31, 2007

(65) Prior Publication Data

US 2007/0279924 A1 Dec. 6, 2007

(30) Foreign Application Priority Data

May 31, 2006 (JP) ..... 2006-151196

(51) Int. Cl.
*F21V 21/00* (2006.01)
*F21V 9/00* (2006.01)

(52) U.S. Cl. ..... 362/545; 362/507; 362/487; 362/543; 362/241

(58) Field of Classification Search ..... 362/543, 362/544, 545, 487, 507, 800, 516, 241, 247; 257/88, 98

See application file for complete search history.

(56) References Cited

U.S. PATENT DOCUMENTS 6,851,843 B2 * 2/2005 Muller et al. ..... 362/555
6,945,672 B2 * 9/2005 Du et al. ..... 362/241
7,048,412 B2 * 5/2006 Martin et al. ..... 362/247
7,134,775 B2 * 11/2006 Oishi et al. ..... 362/545
2002/0118548 A1 * 8/2002 Kuenstler et al. ..... 362/518

FOREIGN PATENT DOCUMENTS

DE 10 2004 038 065 A1 3/2005
JP 2003-31011 A 1/2003
JP 2005-141919 A 6/2005

* cited by examiner

*Primary Examiner*—Jacob Y Choi
(74) *Attorney, Agent, or Firm*—Sughrue Mion, PLLC

(57) ABSTRACT

The reflection surface of a reflector is formed by a parabolic cylindrical plane extending in the horizontal direction orthogonal to an optical axis. A light emitting element is configured to have five light emitting chips arranged in a T-shape and these light emitting chips are lighted in two lighting modes. In the first lighting mode, a special light emitting chip and a pair of the left and right side special light emitting chips which front end edges are aligned on the focal line of the parabolic cylindrical plane are lighted simultaneously, whereby a light distribution pattern having a narrow vertical width and a prolong shape is formed. In the second lighting mode, a special light emitting chip located at the center portion and two general light emitting chips disposed in series on the backward side thereof are lighted simultaneously, whereby a light distribution pattern having a large vertical width and a prolong shape is formed.

8 Claims, 14 Drawing Sheets

112
112a
112b
112aA
112aB
112aC
112aD
112aE
112aF
112aG
112aH
112aI
F
Ax
FL

VEHICULAR LAMP UNIT

This application claims priority from Japanese Patent Application No. 2006-151196, filed May 31, 2006, in the Japanese Patent Office. The priority application is incorporated by reference in its entirety.

TECHNICAL FIELD

The present disclosure relates to a vehicular lamp unit having a light emitting element as a light source.

RELATED ART

In recent years, light emitting elements such as light emitting diodes have been employed frequently as the light source of the vehicular lamp unit.

For example, Japanese Patent Unexamined Publication No. 2003-31011 and Japanese Patent Unexamined Publication No. 2005-141919 disclose a vehicular lamp unit which is configured in a manner that light irradiated from a plurality of light emitting elements disposed in series in a horizontal direction orthogonal to an optical axis extending in the front and rear direction of the lamp unit is reflected in the forward direction by a reflector having a reflection surface of a parabolic cylindrical plane shape.

In this case, the vehicular lamp unit described in 2003-31011 is configured in a manner that all the plurality of light emitting elements are disposed upward. In contrast, the vehicular lamp unit described in 2005-141919 is configured in a manner that all the plurality of light emitting elements are disposed downward.

It becomes possible to form a light distribution pattern prolonged extending sideways by employing the vehicular lamp unit described in 2003-31011 or 2005-141919. In this case, when the light distribution pattern is set to be disposed at a vicinity of a lower side of a cutoff line of a light distribution pattern for a low beam, the road surface in the forward direction of a vehicle can be irradiated widely.

However, each of the vehicular lamp units described in 2003-31011 and 2005-141919 is configured in a manner that the plurality of light emitting elements disposed in a line along the horizontal direction are lighted simultaneously, so that only a single light distribution pattern is formed. Thus, there arises a problem that it is difficult to sufficiently cope with a need that a light distribution pattern for a low beam is suitably changed in accordance with a running state of a vehicle.

Even if the vehicular lamp unit of the aforesaid related art is configured to include a lighting mode in which a part of the plurality of light emitting elements are lighted simultaneously in addition to the aforesaid lighting mode in which all of the plurality of light emitting elements are lighted simultaneously, the brightness of the light distribution pattern prolonged extending sideways merely reduces in the former lighting mode and so it is also difficult to sufficiently cope with the need that the light distribution pattern for a low beam is suitably changed in accordance with a running state of a vehicle.

SUMMARY

Exemplary embodiments of the present invention provide a vehicular lamp unit which has light emitting elements as a light source and can change a light distribution pattern formed by light irradiated from the elements suitably in accordance with a running state of a vehicle.

The exemplary embodiments of the present invention contrives the configuration of a light emitting element to provide the vehicular lamp unit which has light emitting elements as a light source and can change a light distribution pattern formed by light irradiated from the elements suitably in accordance with a running state of a vehicle.

In other words, a vehicular lamp unit according to a first exemplary embodiment of the present invention is arranged to include a light emitting element, which is disposed on an optical axis extending in forward and backward directions of the lamp unit so as to be directed downward, and which has a plurality of light emitting chips mounted on a board and disposed with a predetermined arrangement so as to be adjacent to each other; and a reflector, which reflects light emitted from the light emitting element to a forward direction and which has a reflection surface having a section along a vertical plane containing the optical axis, the section formed of a parabolic shape having a focal point on the optical axis.

The plurality of light emitting chips are configured by a plurality of special light emitting chips which front end edges are aligned on a horizontal line orthogonal to the optical axis passing through the focal point of the parabolic section and at least one general light emitting chip disposed on a backward side from the plurality of special light emitting chips.

The light emitting chips in each of at least two sets of light emitting chips, each set being selected so as to include at least one special light emitting chip of the plurality of special light emitting chips, are simultaneously lighted in a lighting mode corresponding to the respective set.

A vehicular lamp unit according to a second exemplary embodiment of the present invention is arranged to include a light emitting element, which is disposed on an optical axis extending in forward and backward directions of the lamp unit so as to be directed upward, and which has a plurality of light emitting chips mounted on a board and disposed with a predetermined arrangement so as to be adjacent to each other; and a reflector, which reflects light emitted from the light emitting element to a forward direction, and which has a reflection surface having a section along a vertical plane containing the optical axis is formed of a parabolic shape having a focal point on the optical axis.

The plurality of light emitting chips are configured by a plurality of special light emitting chips which rear end edges are aligned on a horizontal line orthogonal to the optical axis passing through the focal point of the parabolic section and at least one general light emitting chip disposed on a forward side from the plurality of special light emitting chips.

The light emitting chips in each of at least two sets of light emitting chips, each set being selected so as to include at least one special light emitting chip of the plurality of special light emitting chips, are simultaneously lighted in a lighting mode corresponding to the respective set.

A kind of the "vehicular lamp unit" is not limited to a particular type, and thus a head lamp, a fog lamp, a cornering lamp, a daytime running lamp or lamp unit piece, etc., constituting a part thereof may be employed.

The "optical axis" may coincide or may not coincide with an axis line extending in the forward and backward directions of a vehicle so long as the optical axis is an axial line extending in the forward and backward directions of the lamp unit.

The "light emitting element" may mean a light source of an element-fashion having light emitting chips which perform plane emission in an almost dot manner, and the kind thereof is not particularly limited and a light emitting diode or a laser diode, etc., may be employed as the element.

The "plurality of light emitting chips" are configured by the plurality of special light emitting chips and the at least one general light emitting chip, but the quantity thereof is not limited particularly.

The "downward" in the first exemplary embodiment of the present invention may of course be a vertically downward direction but also may be a slanted direction with respect to the vertically downward direction. In the similar manner, the "upward" in the second exemplary embodiment of the present invention may of course be a vertically upward direction but also may be a slanted direction with respect to the vertically upward direction.

As to the "plurality of special light emitting chips", the quantity of the chips, the concrete shapes of these respective special light emitting chips and the positional relation between the chips and the optical axis are not particularly limited so long as the special light emitting chips are disposed in a manner that the front end edges thereof are aligned on the horizontal line orthogonal to the optical axis passing through the focal point of the parabolic section, or so long as the special light emitting chips are disposed in a manner that the rear end edges thereof are aligned on the horizontal line orthogonal to the optical axis passing through the focal point of the parabolic section.

Further, as to the "at least one general light emitting chip", the quantity of the chips, the concrete shapes of these respective general light emitting chips and the positional relation between the plurality of the special light emitting element chips and the general light emitting element chips are not particularly limited so long as the general light emitting chips are disposed on the backward side than the plurality of the special light emitting chips, or so long as the general light emitting chips are disposed on the forward side than the plurality of the special light emitting chips.

The "reflection surface" of the reflector is not limited particularly in its sectional shape so long as its section along the vertical plane including the optical axis thereof is constituted by a parabolic shape having a focal point on the optical axis. Further, the "parabolic shape" constituting the vertical section of the "reflection surface" is not particularly limited so long as it has a focal point on the optical axis, and the axis may or may not coincide with the optical axis.

As to the "at least two sets of plural light emitting chips, each set being selected", the concrete structure of sets thereof is not limited particularly so long as each set is selected to include at least one of the plurality of the special light emitting chips, and the quantity of sets is also not limited particularly.

One or more exemplary embodiments of the present invention may include one or more of the following advantages. For example, as shown in the aforesaid configuration, the vehicular lamp unit according to the first exemplary embodiment of the present invention is arranged to include the light emitting element which is disposed on the optical axis extending in forward and backward directions of the lamp unit so as to be directed downward and the reflector which reflects light emitted from the light emitting element to the forward direction.

The light emitting element is mounted on the board in a manner that the plurality of light emitting chips are disposed with the predetermined arrangement so as to be adjacent to each other.

The reflector has a reflection surface having a section along the vertical plane containing the optical axis, the section formed of the parabolic shape having a focal point on the optical axis.

The plurality of light emitting chips are configured by the plurality of special light emitting chips which front end edges are aligned on the horizontal line orthogonal to the optical axis passing through the focal point of the parabolic section and at least one general light emitting chip disposed on the backward side from the plurality of special light emitting chips.

The light emitting chips in each of at least two sets of plural light emitting chips, each set being selected so as to include at least one special light emitting chip of the plurality of special light emitting chips, are simultaneously lighted in a lighting mode corresponding to the respective set.

The vehicular lamp unit according to the second exemplary embodiment of the present invention is arranged to include the light emitting element which is disposed on the optical axis extending in forward and backward directions of the lamp unit so as to be directed upward and the reflector which reflects light emitted from the light emitting element to the forward direction.

The light emitting element is mounted on the board in a manner that the plurality of light emitting chips are disposed with the predetermined arrangement so as to be adjacent to each other.

The reflector has a reflection surface having a section along the vertical plane containing the optical axis, the section formed of the parabolic shape having a focal point on the optical axis.

The plurality of light emitting chips are configured by the plurality of special light emitting chips which rear end edges are aligned on the horizontal line orthogonal to the optical axis passing through the focal point of the parabolic section and at least one general light emitting chip disposed on the forward side from the plurality of special light emitting chips.

The light emitting chips in each of at least two sets of plural light emitting chips, each set being selected so as to include at least one special light emitting chip of the plurality of special light emitting chips, are simultaneously lighted in a lighting mode corresponding to the respective set.

That is, when a part or all of the plurality of special light emitting chips are set to be lighted simultaneously, it is possible to form the light distribution pattern in which the vertical width thereof is small and the upper end portion thereof is relatively bright. According to such a light distribution pattern, a long distance area on the road surface ahead of the vehicle can be irradiated efficiently thereby to enhance the visibility in a distant area, whereby this pattern can be suitable for a high vehicle speed.

Further, when a part or all of the plurality of special light emitting chips and a part or all of the general light emitting chips are set to be lighted simultaneously, it is possible to form the light distribution pattern in which the vertical width thereof is large and the upper end portion thereof is relatively bright. According to such a light distribution pattern, the road surface ahead of the vehicle can be irradiated widely from a near area to a distant area, whereby this pattern can be suitable for an urban area.

According to the first and section exemplary embodiments of the present invention, in the vehicular lamp unit having the light emitting element as the light source, the light distribution pattern formed by the irradiation light from the vehicular lamp unit can be suitably changed in accordance with the running state of a vehicle.

For example, in the case where the light distribution pattern for a low beam is formed as a composite light distribution pattern which is configured by a light distribution pattern formed by irradiating light from the vehicular lamp unit according to the exemplary embodiment of the present invention and a light distribution pattern formed by irradiating light from another vehicular lamp unit, the light distribution pattern for a low beam can be suitably changed in accordance with the running state of a vehicle. When the vehicular lamp unit according to the exemplary embodiment of the present invention is used as a cornering lamp, the light distribution pattern of the cornering lamp formed by the irradiation light from the lamp can be suitably changed in accordance with a vehicle speed at the time of turning a road.

In the aforesaid configuration, a plurality of the general light emitting chips are disposed in series in the forward and backward directions of the lamp unit, and the lighting mode includes a first lighting mode in which at least two of the plurality of special light emitting chips are simultaneously lighted and a second lighting mode in which at least one of the plurality of special light emitting chips and the general light emitting chips are simultaneously lighted. In this case, the following actions and effects can be obtained.

That is, the first lighting mode forms a first light distribution pattern in which the vertical width thereof is small and the upper end portion thereof is relatively bright, whereby this pattern can be suitable for a high vehicle speed. Further, the second lighting mode forms a second light distribution pattern in which the brightness at the upper end portion thereof is secured to a certain level and the pattern thereof is widened on the lower side than the first light distribution pattern, whereby this pattern can be suitable for an urban area. Further, when such the configuration is employed, the number of the light emitting chips simultaneously lighted can be kept to a constant value or a similar value, whereby an amount of consumption power of the light emitting element can be suppressed.

In the aforesaid configuration, a plurality of the light emitting chips are disposed in a matrix arrangement, and the lighting mode includes a first lighting mode in which the plurality of special light emitting chips are simultaneously lighted and a second lighting mode in which at least one or all of the plurality of special light emitting chips and at lease one or all of the general light emitting chip are simultaneously lighted, whereby an amount of consumption power of the light emitting element can be suppressed.

That is, the first lighting mode forms a first light distribution pattern in which the vertical width thereof is small and the upper end portion thereof is relatively bright, whereby this pattern can be suitable for a high vehicle speed. Further, the second lighting mode forms a second light distribution pattern in which a light distribution pattern having a shape formed by widening the first light distribution pattern downward is added while maintaining the first light distribution pattern as it is, whereby this pattern can be suitable for a running in a mountain area having many curved roads.

In the aforesaid configuration, the reflection surface of the reflector is configured by a parabolic cylindrical plane which has a parabolic vertical section and which extends extending in the horizontal direction orthogonal to the optical axis. Thus, a light distribution pattern prolonged extending sideways can be formed from the reflection light from the reflection surface, whereby the road surface ahead of a vehicle can be irradiated widely.

Other features and advantages may be apparent from the following detailed description, the accompanying drawings and the claims.

BRIEF DESCRIPTION OF THE DRAWINGS

FIGS. 5A and 5B are perspective views each showing a light distribution pattern formed on an imaginary vertical screen placed 25 m ahead from the lamp by light irradiated in the forward direction from the vehicular lamp unit, wherein FIG. 5A shows a light distribution pattern formed by a first lighting mode and FIG. 5B shows a light distribution pattern formed by a second lighting mode.

FIGS. 8A to 8C are perspective views each showing a light distribution pattern formed on the imaginary vertical screen by light irradiated in the forward direction from the vehicular headlamp unit according to the second exemplary embodiment, in which FIG. 8A shows a light distribution pattern formed by the first lighting mode, FIG. 8B shows a light distribution pattern formed by the second lighting mode, and FIG. 8C shows a light distribution pattern formed by the third lighting mode.

FIGS. 10A and 10B are perspective views each showing a light distribution pattern formed on the imaginary vertical screen by light irradiated in the forward direction from the vehicular headlamp unit according to the third exemplary embodiment, in which FIG. 10A shows a light distribution pattern formed by the first lighting mode, and FIG. 10B shows a light distribution pattern formed by the second lighting mode.

FIGS. 13A to 13B are perspective views each showing a light distribution pattern formed on the imaginary vertical screen by light irradiated in the forward direction from the vehicular headlamp unit according to the fifth exemplary embodiment, in which FIG. 13A shows a light distribution pattern formed by the first lighting mode, and FIG. 13B shows a light distribution pattern formed by the second lighting mode.

DETAILED DESCRIPTION

Hereinafter, exemplary embodiments of the present invention will be explained with reference to drawings First, the first exemplary embodiment of the invention will be explained.

Figure 1:
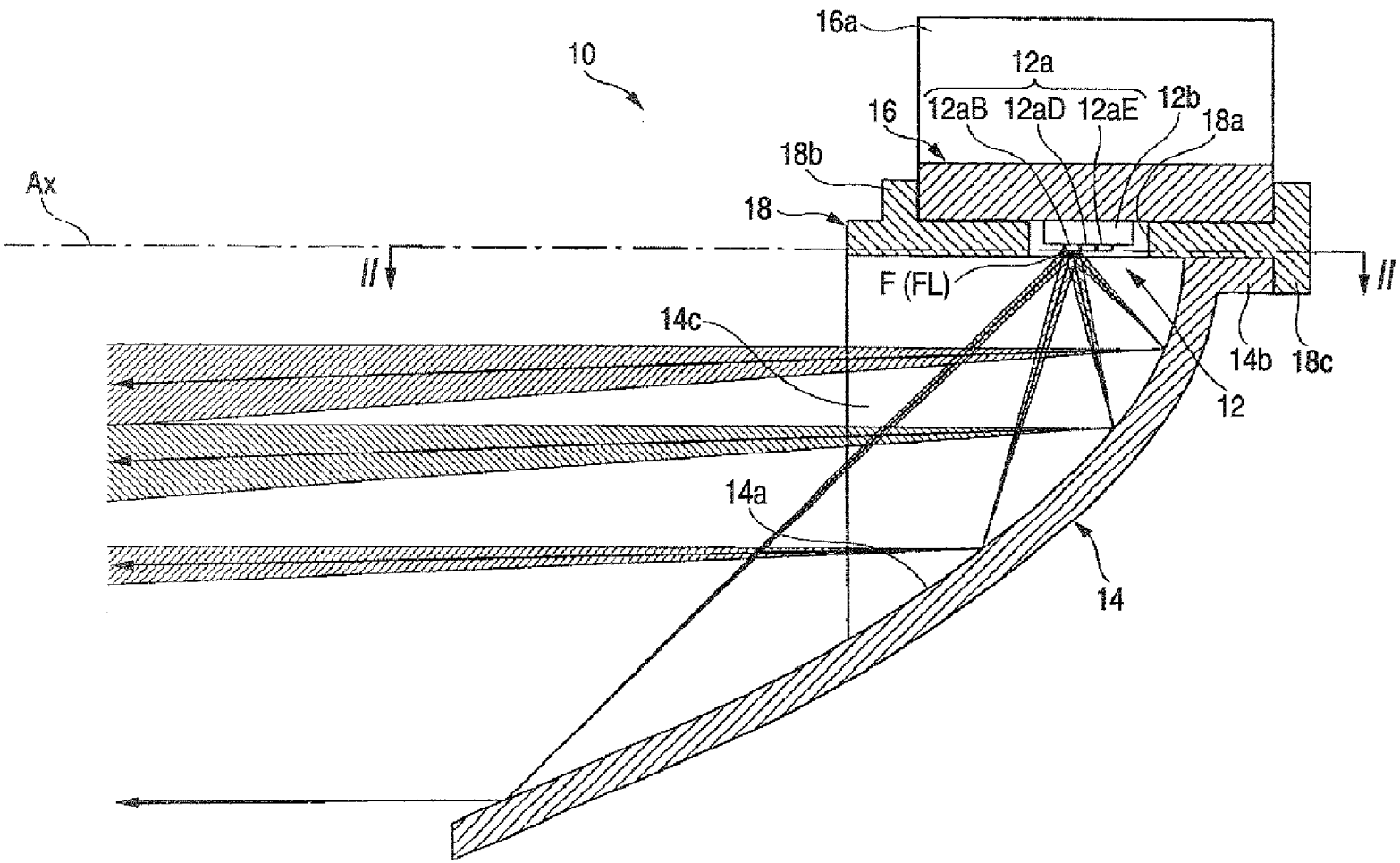
FIG. 1 is a side sectional view of a vehicular lamp unit according to a first exemplary embodiment of the present invention.
Figure 2:
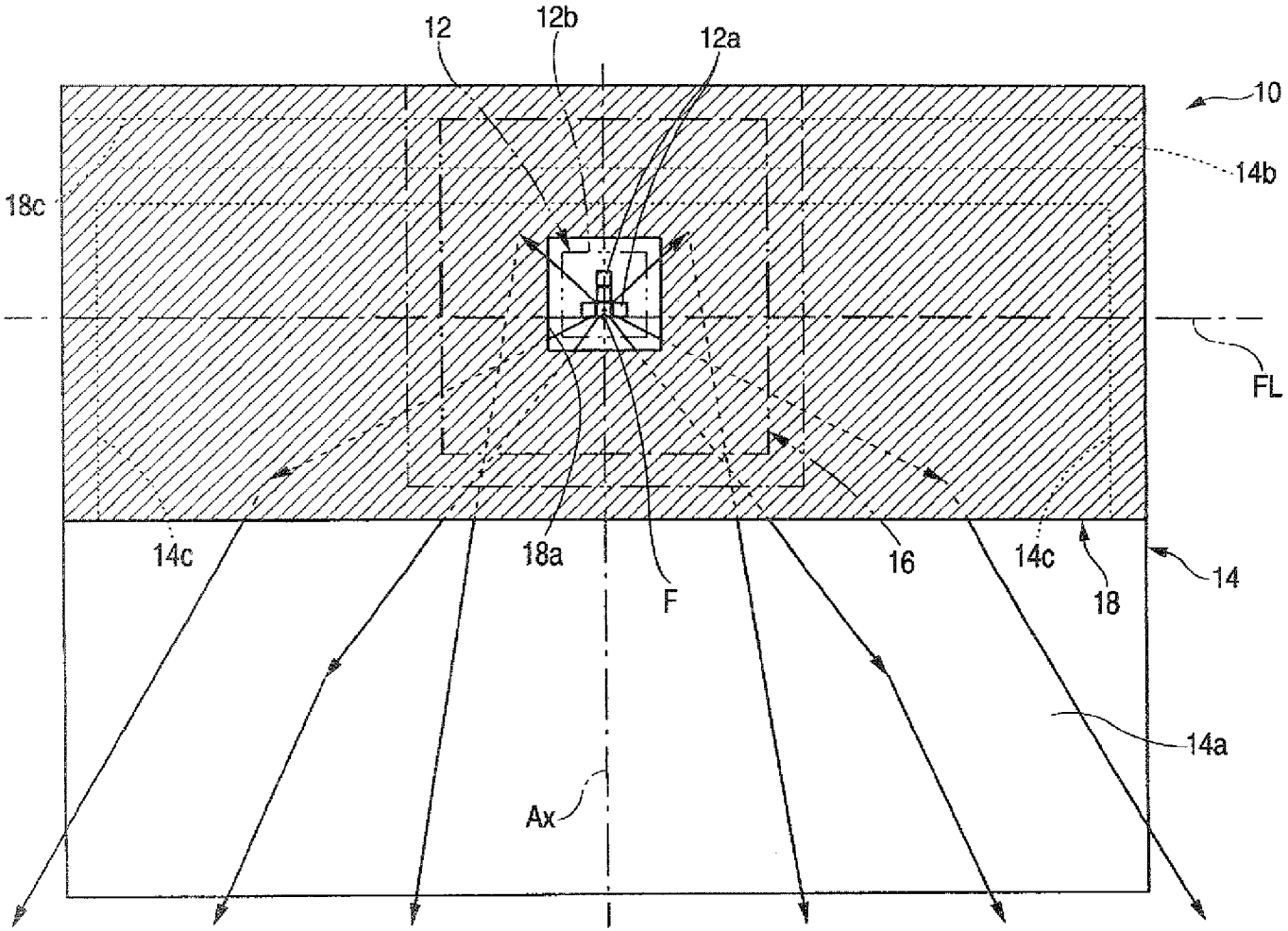
FIG. 2 is a sectional diagram cut along a line II-II in FIG. 1.

FIG. 1 is a side sectional view of a vehicular lamp unit 10 according to the first exemplary embodiment. FIG. 2 is a sectional diagram cut along a line II-II in FIG. 1.

As shown in these figures, the vehicular lamp unit 10 according to the embodiment is configured to include a light emitting element 12 which is disposed on an optical axis Ax extending in the front and rear directions of the lamp unit so as to be directed downward and a reflector 14 which is disposed on the lower side of the light emitting element 12 so as to reflect light emitted from the light emitting element 12 in the forward direction.

The vehicular lamp unit 10 is incorporated within a not-shown lamp body and used as a part of a vehicular head lamp in a state that the optical axis Ax is disposed so as to extend in a downward direction by almost 0.5 through 0.6 degree with respect to an axial line extending in the front and rear direction of a vehicle.

The light emitting element 12 is a white light emitting diode and is configured in a manner such that five light emitting chips 12*a* are mounted on a board 12*b* in a T-shaped arrangement so as to be adjacent to each other with a small interval. In this case, each of the light emitting chips 12*a* has a light emission surface of a square shape each side of which is about 1 mm in length. The light emission surface is sealed by a thin film.

The light emitting element 12 is fixedly supported on a supporting plate 16 in a state that the five light emitting chips 12*a* are directed to a downward direction vertically. The supporting plate 16 is fixedly supported on a holder 18 in a state that the supporting plate is disposed so as to extend along the horizontal plane. A plurality of radiation fins 16*a* are formed on the upper surface of the supporting plate 16 so as to extend in the vertical direction.

The reflection surface 14*a* of the reflector 14 is configured by a parabolic cylindrical plane. In this case, the parabolic cylindrical plane constituting the reflection surface 14*a* is formed in a manner that the vertical section thereof has a parabolic shape having the optical axis Ax as an axis thereof and a focal point F on the optical axis Ax and that the parabolic cylindrical plane extends in the horizontal direction orthogonal to the optical axis Ax. The reflector 14 has a horizontal flange portion 14*b* at the rear end potion thereof and also has side wall portions 14*c* at the rear half portions of the left and right sides thereof, respectively. The holder 18 is fixedly supported on the upper surface of the horizontal flange portion 14*b* and the side wall portions 14*c*.

The holder 18 is provided with an opening portion 18*a* for housing the light emitting element 12 therein, an annular flange portion 18*b* for positioning the supporting plate 16 and a rear end flange portion 18*c* for positioning the reflector 14.

Figure 3A:
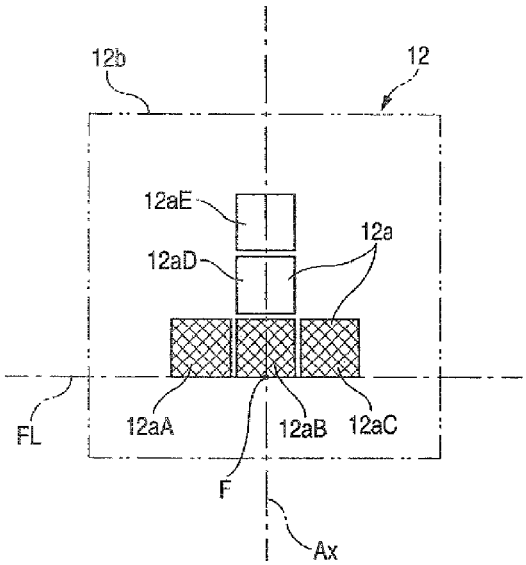
FIGS. 3A and 3B are detailed diagrams of the main portion of FIG. 2 which show the detailed configuration of the light emitting element of the vehicular lamp unit.
Figure 3B:
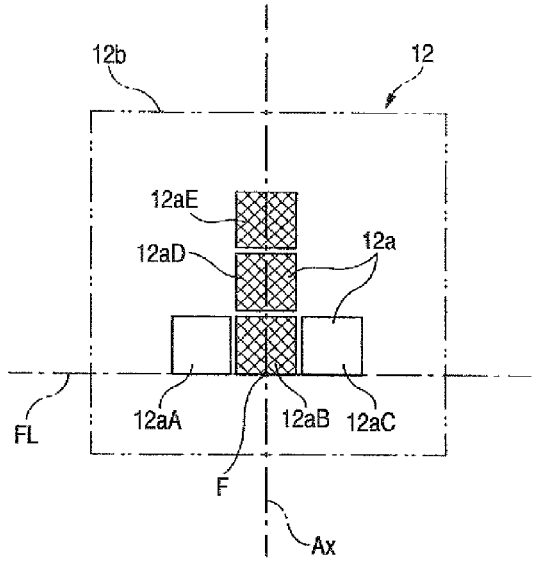

FIGS. 3A and 3B are detailed diagrams of the main portion of FIG. 2 which show the detailed configuration of the light emitting element 12.

As shown in these figures, the five light emitting chips 12*a* are configured by three special light emitting chips 12*a*A, 12*a*B, 12*a*C and two general light emitting chips 12*a*D, 12*a*E.

The three special light emitting chips 12*a*A, 12*a*B, 12*a*C are disposed in a manner that the front end edges thereof are aligned on a focal line FL (that is, the horizontal line orthogonal to the optical axis Ax passing through the focal point F of the parabolic section) of the parabolic cylindrical plane constituting the reflection surface 14*a* of the reflector 14. In this case, the special light emitting chip 12*a*B located at the center portion is disposed on the optical axis Ax. The remaining two general light emitting chips 12*a*D, 12*a*E are disposed in series on the optical axis Ax so as to be directed backward from the special light emitting chip 12*a*B located at the center portion As lighting modes, the light emitting element 12 has a first lighting mode in which the three special light emitting chips 12*a*A, 12*a*B, 12*a*C are lighted simultaneously as shown by hatched areas in FIG. 3A and a second lighting mode in which the special light emitting chip 12*a*B located at the center portion and the two general light emitting chips 12*a*D, 12*a*E are lighted simultaneously as shown by hatched areas in FIG. 3B. These two lighting modes may be switched by the manual operation of a drive or automatically in accordance with a running state of the vehicle. As a concrete example of the automatic switching, for example, it is possible to perform the second lighting mode when a vehicle speed is less than a predetermined speed (for example, 50 km/h) and perform the first lighting mode when the vehicle speed is equal to or greater than the predetermined speed.

Almost all of the emitting light emitted from each of the light emitting chips 12*a* is incident on the reflection surface 14*a* of the reflector 14. Since the reflection surface 14*a* is configured as a parabolic cylindrical plane extending in the horizontal direction, the emitting light from each of the light emitting chips 12*a* incident on the reflection surface 14*a* is reflected by the reflection surface 14*a* and then irradiated in the forward direction as light which scarcely diffuses in the vertical direction but diffuses largely in the horizontal direction.

FIGS. 1 and 2 show an optical path of the light emitted from the special light emitting chip 12*a*B located at the center portion.

Since the special light emitting chip 12*a*B is disposed in a manner that the front end edge thereof is located on the focal line FL on the optical axis Ax, the light emitted from the front end edge thereof is reflected on the reflection surface 14*a* and then directed in a direction parallel to the optical axis Ax with respect to the vertical direction, as shown in FIG. 1. Light emitted from the rear end edge of the special light emitting chip 12*a*B is reflected downward with respect to the optical axis Ax by an angle corresponding to the width of the light emitting chip 12*a* in the front and rear directions, and light emitted from the light emission center of the special light emitting chip 12*a*B is directed downward by an angle almost half of the aforesaid angle. The light from the special light emitting chip 12*a*B is reflected by the reflection surface 14*a* with an open angle which becomes smaller as the reflection point approaches the lower end edge of the reflection surface 14*a*. Further, as shown in FIG. 2, the light rays emitted from the special light emitting chip 12*a*B are reflected by the respective points of the reflection surface 14*a* and diffuse largely on both the left and right sides of the optical axis Ax uniformly with respect to the horizontal direction.

Optical paths of light emitted from each of the special light emitting chips 12*a*A, 12*a*C located on both the left and right sides of the special light emitting chip 12*a*B are formed in the similar manner as those of the special light emitting chip 12*a*B.

Figure 4:
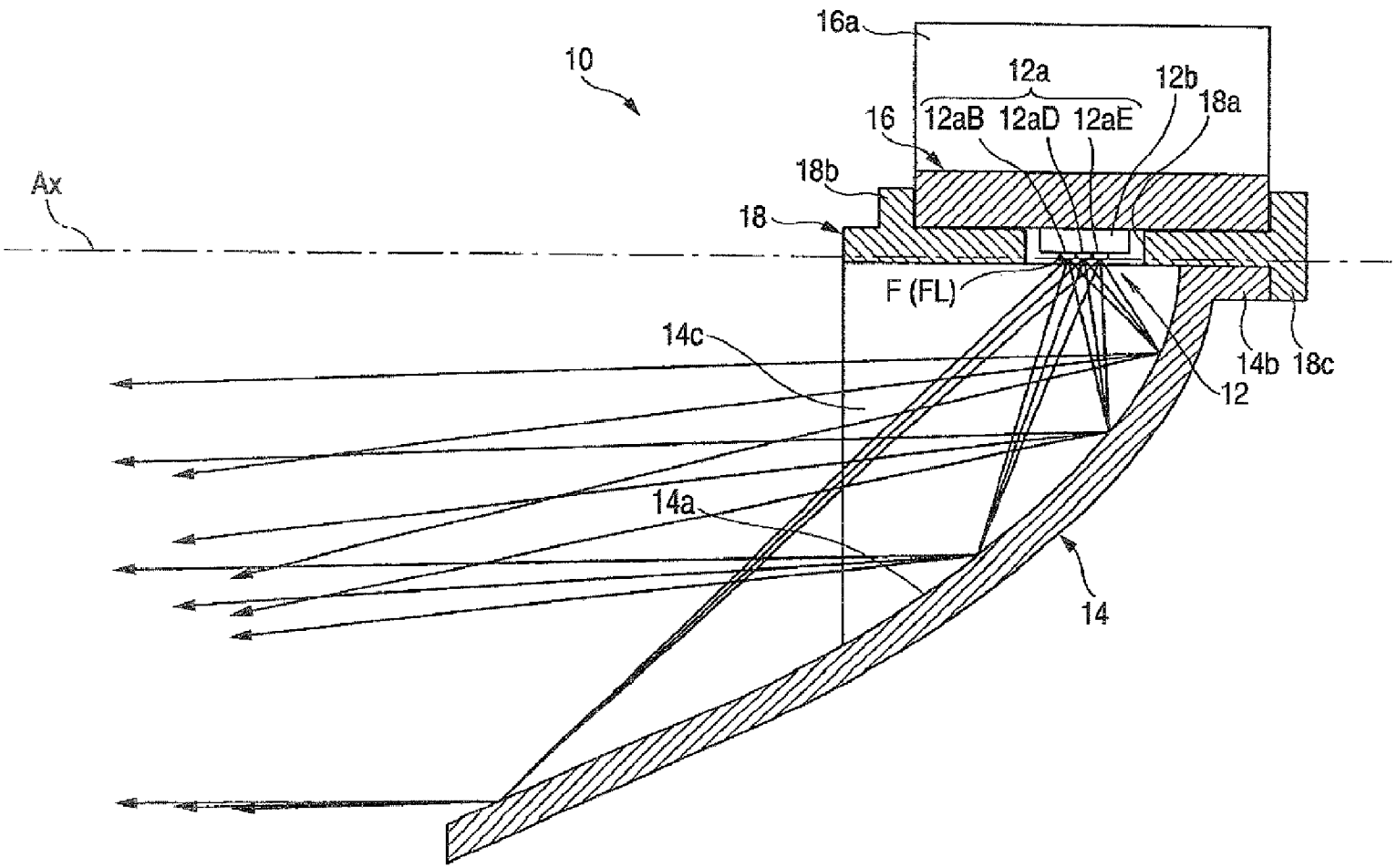
FIG. 4 is a diagram similar to FIG. 1, which shows an optical path of light emitted from the light emission center of each of the special light emitting chip and the general light emitting chips.

FIG. 4 is a diagram similar to FIG. 1, which shows an optical path of light emitted from the light emission center of each of the special light emitting chip 12*a*B and the general light emitting chips 12*a*D, 12*a*E.

As shown in the figure, light emitted from the general light emitting chip 12*a*D adjacent to the special light emitting chip 12*a*B on the rear side thereof is reflected downward on the reflection surface 14*a* by an angle corresponding to the pitch between the light emission centers of these light emitting chips 12*a*B, 12*a*D as compared with the emitting light from the special light emitting chip 12*a*B. Light emitted from the general light emitting chip 12*a*E adjacent to the general light emitting chip 12*a*D on the rear side thereof is reflected further downward on the reflection surface 14*a* by an angle corresponding to the pitch between the light emission centers of these light emitting chips 12*a*D, 12*a*E as compared with the emitting light from the general light emitting chip 12*a*D.

Figure 5A:
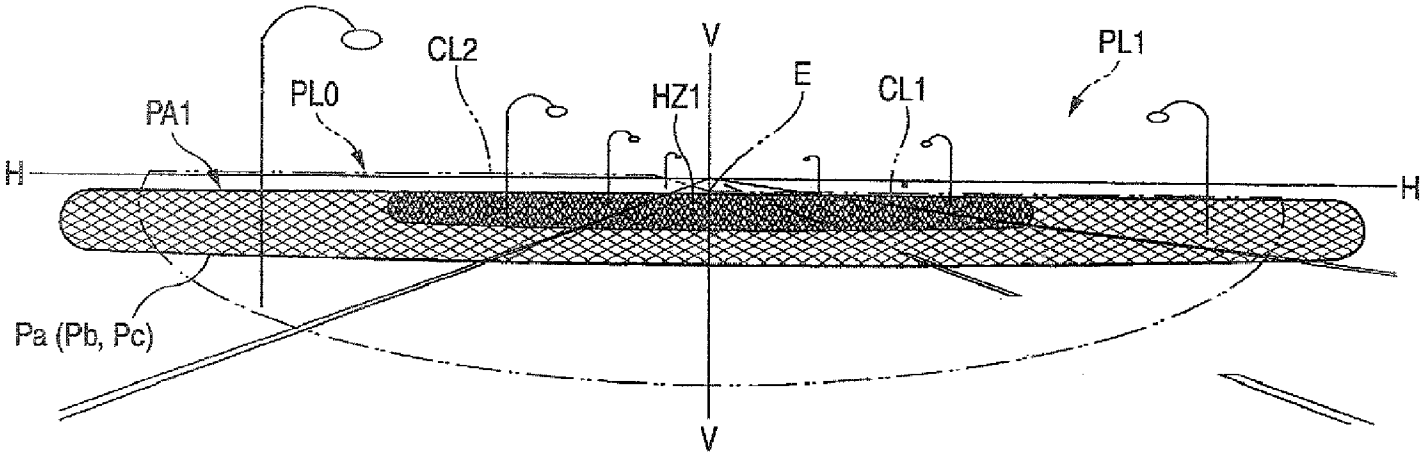
Figure 5B:
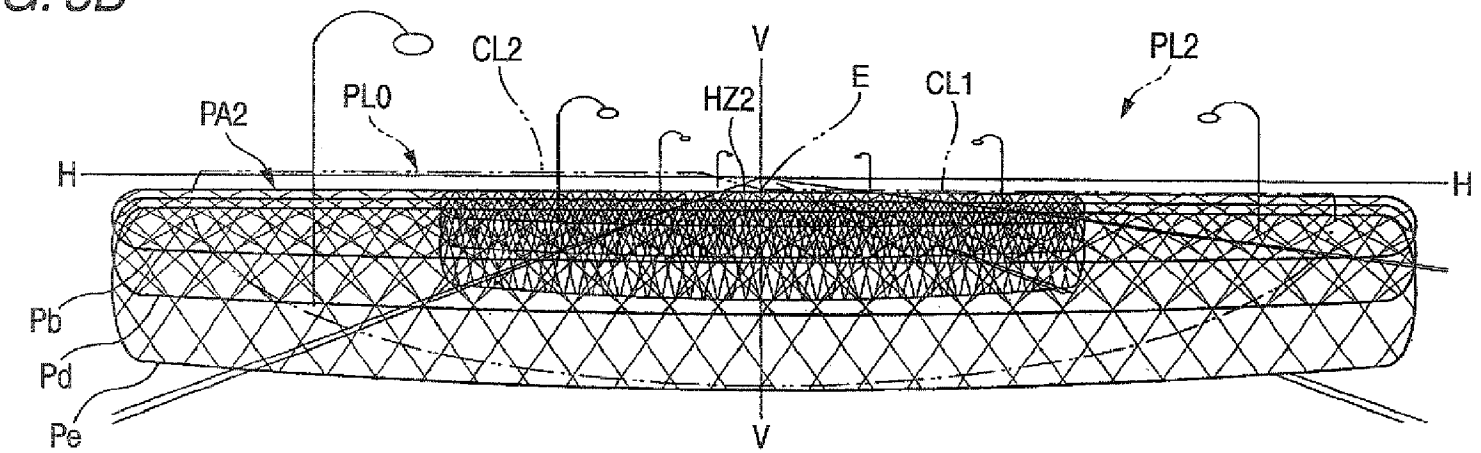

FIGS. 5A and 5B are perspective views each showing a light distribution pattern formed on an imaginary vertical screen placed 25 m ahead from the lamp by light irradiated in the forward direction from the vehicular lamp unit 10 according to the first exemplary embodiment. In this case, FIG. 5A shows a light distribution pattern PA1 formed by the first lighting mode and FIG. 5B shows a light distribution pattern PA2 formed by the second lighting mode.

As shown in these figures, these light distribution patterns PA1, PA2 are composed with a basic light distribution pattern PL0 shown by a two-dot chain line in the figure to form low-beam light distribution patterns PL1, PL2, respectively.

The basic light distribution pattern PL0 is a light distribution pattern for a low beam for a left light distribution formed by emitting light from a not-shown another vehicular headlamp unit and has cutoff lines CL1, CL2 at the upper end edge thereof.

As to these cutoff lines CL1, CL2, the cutoff line CL1 on an opposite lane side located on the right side of a V-V line (that is, a vertical line passing H-V which is the focal point in the front direction of the lamp) is formed to extend in the horizontal direction, and the cutoff line CL2 on an own vehicle lane side located on the left side of the V-V line is formed so as to rise obliquely with a predetermined angle (for example, 15 degrees) from the cutoff line CL1 on the opposite lane side to a position slightly above an H-H line (that is, a horizontal line passing H-V) and then extend horizontally.

In the basic light distribution pattern PL0, an elbow point E constituting an intersection of the cutoff line CL1 on the opposite lane side and the V-V line is set to a position downward from the H-V by about 0.5 through 0.6 degree.

As shown in FIG. 5A, the light distribution pattern PA1 is formed as a composite light distribution pattern of three light distribution patterns Pa, Pb, Pc each having almost the same configuration respectively formed by emitting lights from the special light emitting chips 12*a*A, 12*a*B, 12*a*C simultaneously lighted in the first lighting mode.

The light distribution pattern PA1 is a light distribution pattern prolonged extending sideways, which extends largely on both the left and right sides uniformly around the V-V line beneath the H-H line, and the upper end edge thereof is formed so as to almost coincide with the opposite lane side cutoff line CL1. In this case, the light distribution pattern PA1 is formed as a light distribution pattern having a narrow vertical width, and the high intensity area HZ1 thereof is formed so as to extend in a long and narrow manner in the left and right directions around the V-V line at a vicinity of a lower side of the elbow point E.

The light distribution pattern PA1 is formed as the light distribution pattern prolonged extending sideways having the narrow vertical width and the upper end portion thereof is relatively bright. This is because the reflection surface 14*a* of the reflector 4 is configured by the parabolic cylindrical plane and the three special light emitting chips 12*a*A, 12*a*B, 12*a*C are disposed in a manner that the front end edges thereof are aligned on the focal line FL of the parabolic cylindrical plane. Further, the upper end edge of the light distribution pattern PA1 almost coincides with the opposite lane side cutoff line CL1 because the optical axis Ax of the vehicular lamp unit 10 is arranged to extend downward by about 0.5-0.6 degree with respect to the axis line extending in the front and rear directions of the vehicle.

As shown in FIG. 5B, the light distribution pattern PA2 is formed as a composite light distribution pattern of light distribution patterns Pb, Pd, Pe respectively formed by emitting lights from the special light emitting chip 12*a*B and the two general light emitting chips 12*a*D, 12*a*E simultaneously lighted in the second lighting mode.

In this case, the light distribution pattern Pb is formed by the emitting light from the special light emitting chip 12*a*B and hence has an almost similar shape as that of the light distribution pattern PA1. The light distribution pattern Pd is formed by the emitting light from the general light emitting chip 12*a*D adjacent to the backward side of the special light emitting chip 12*a*B and hence has a shape which is formed by slightly shifting the light distribution pattern Pb downward and slightly widening this pattern downward. The light distribution pattern Pe is formed by the emitting light from the general light emitting chip 12*a*E adjacent to the backward side of the general light emitting chip 12*a*D and hence has a shape which is formed by further slightly shifting the light distribution pattern Pb downward and slightly widening this pattern downward.

Like the light distribution pattern PA1, this light distribution pattern PA2 is a light distribution pattern prolonged extending sideways, which extends largely on both the left and right sides uniformly around the V-V line beneath the H-H line, and the upper end edge thereof is formed so as to almost coincide with the opposite lane side cutoff line CL1. However, since the light distribution pattern PA2 is formed as the composite light distribution pattern of the light distribution patterns Pb, Pd, Pe, this light distribution pattern has a larger vertical width as compared with the light distribution pattern PA1, and a high intensity area HZ2 thereof is formed to extend in a long and narrow manner in the left and right directions around the V-V line at a vicinity of a lower side of the elbow point E but to have a vertical width larger than that of the high intensity area HZ1.

As described in detail, the vehicular lamp unit 10 according to the first exemplary embodiment is arranged in a manner that the reflection surface 14*a* of the reflector 14 thereof is configured by the parabolic cylindrical plane extending in the horizontal direction orthogonal to the optical axis Ax, and the light emitting element 12 has the first lighting mode in which, of the five light emitting chips 12*a* arranged in the T-shape, the three special light emitting chips 12*a*A, 12*a*B, 12*a*C which front end edges are aligned on the focal line FL of the parabolic cylindrical plane are lighted simultaneously and the second lighting mode in which the special light emitting chip 12*a*B located at the center portion of the three special light emitting chips and the remaining two general light emitting chips 12*a*D, 12*a*E are lighted simultaneously, whereby the vehicular lamp unit has the following actions and effects.

That is, the first lighting mode can form the light distribution pattern PA1 of the long and narrow shape in which the vertical width thereof is small and the upper end portion thereof is relatively bright. As a result, a long distance area on the road surface ahead of the vehicle can be irradiated efficiently and widely in the left and right directions thereby to enhance the visibility in a distant area, whereby the first lighting mode can be suitable for a high vehicle speed.

The second lighting mode can form the light distribution pattern PA2 of the long and narrow shape in which the vertical width thereof is large and the upper end portion thereof is relatively bright. As a result, the road surface ahead of the vehicle can be irradiated widely in the left and right directions from a near area to a distant area, whereby the second lighting mode can be suitable for an urban area.

According to the vehicular lamp unit 10 of the first exemplary embodiment thus configured, each of the light distribution patterns PA1, PA2 formed by the irradiation light from the vehicular lamp unit can be suitably changed in accordance with the running state of the vehicle.

In this exemplary embodiment, since the low-beam light distribution patterns PL1, PL2 are formed as the composite light distribution patterns of the light distribution patterns PA1, PA2 formed by the irradiation lights from the vehicular lamp unit 10 and the basic light distribution pattern PL0 formed by the irradiation lights from another vehicular lamp unit, respectively, the light distribution pattern for a low beam can be suitably changed in accordance with the running state of the vehicle.

Further, in this exemplary embodiment, since the number of the light emitting chips 12*a* simultaneously lighted in each of the first and second lighting modes is suppressed to a relatively small number, for example, three, an amount of consumption power of the light emitting element 12 can be suppressed.

Next, the second exemplary embodiment of the invention will be explained.

Figure 6:
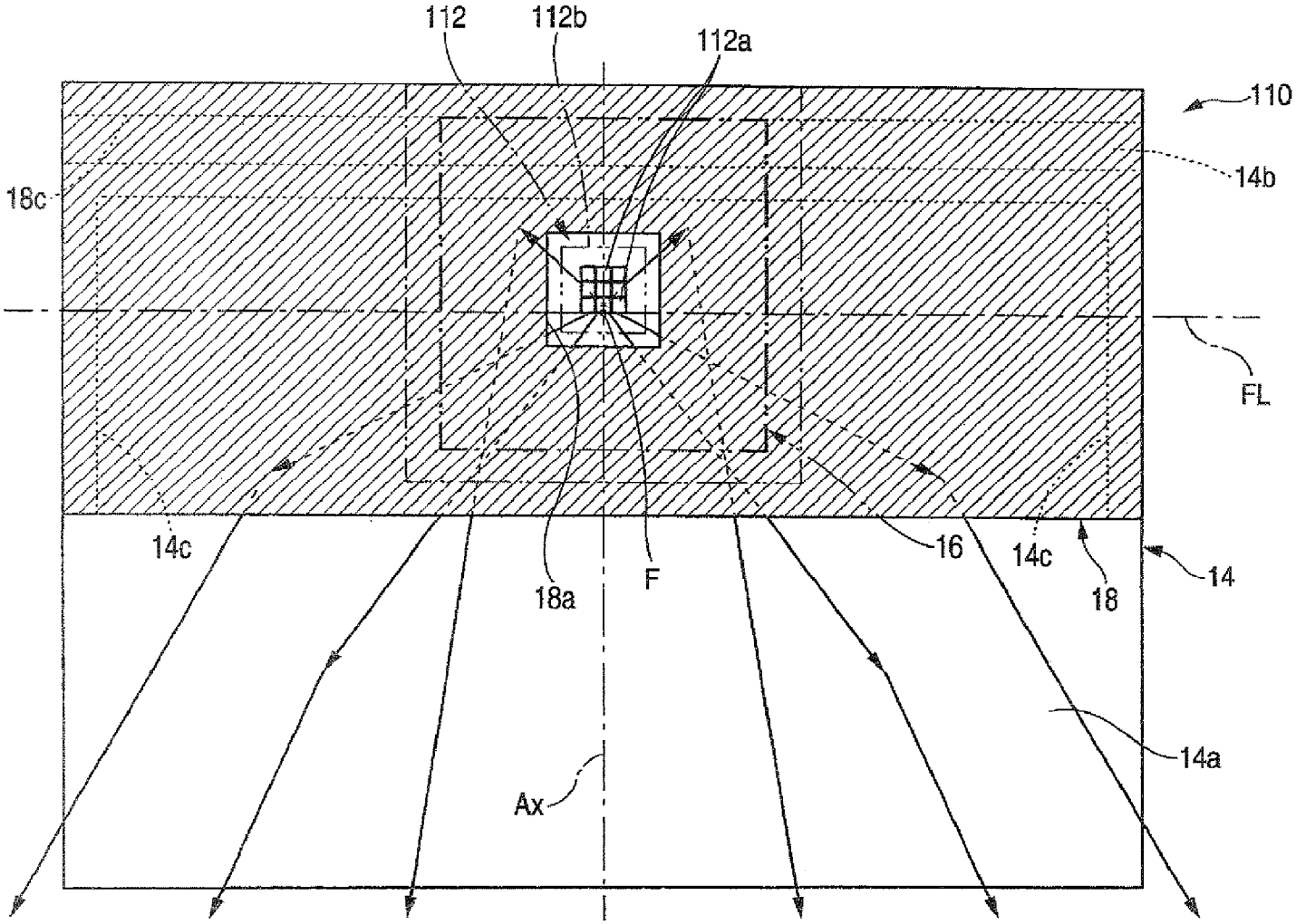
FIG. 6 is a diagram showing the vehicular lamp unit according to a second exemplary embodiment of the present invention and is similar to FIG. 2.

FIG. 6 is a diagram showing a vehicular lamp unit 110 according to this exemplary embodiment and is similar to FIG. 2.

As shown in this figure, the vehicular lamp unit 110 according to this exemplary embodiment is same in its basic configuration as that of the vehicular lamp unit 10 of the first exemplary embodiment but differs from the first exemplary embodiment in the number and the arrangement of the light emitting chips 112*a* of a light emitting element 112.

Figures 7A, 7B, 7C:
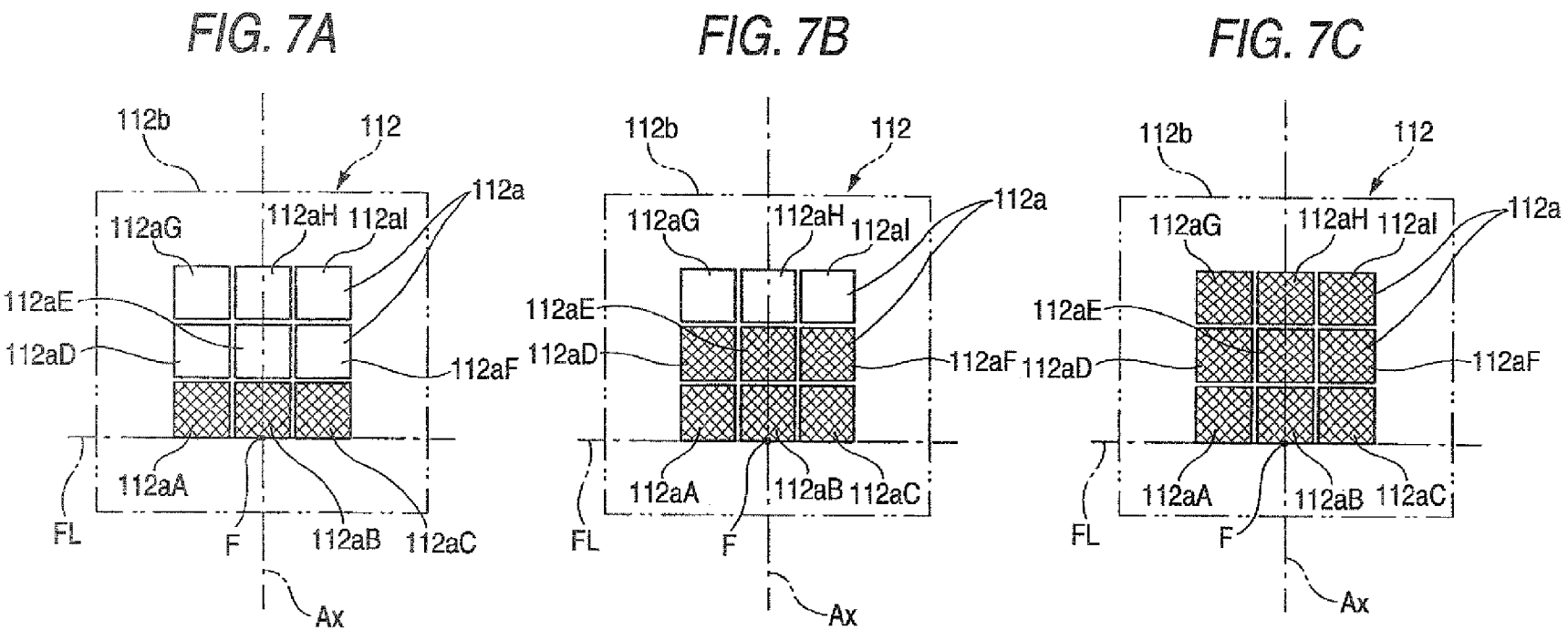
FIGS. 7A to 7C are detailed diagrams showing the configuration of the light emitting element of the vehicular lamp unit according to the second exemplary embodiment of the present invention and is similar to FIG. 3.

That is, like the light emitting element 12 of the first exemplary embodiment, the light emitting element 112 is a white light emitting diode and is configured in a manner that nine light emitting chips 112*a* are mounted on a board 112*b* in a 3×3 matrix arrangement so as to be adjacent to each other with a small interval. In this case, each of the light emitting chips 112*a* has a light emission surface of a square shape each side of which has about a 1 mm length. The light emission surface is sealed by a thin film FIGS. 7A to 7C are detailed diagrams of the main portion of FIG. 6 which show the detailed configuration of the light emitting element 112.

As shown in these figures, of the nine light emitting chips 112*a*, each of the three light emitting chips 112*a*A, 112*a*B, 112*a*C located at the front row constitutes a special light emitting chip and each of the remaining six light emitting chips 112*a*D, 112*a*E, 112*a*F, 112*a*G, 112*a*H 112*a*I constitutes a general light emitting chip.

The three special light emitting chips 112*a*A, 112*a*B, 112*a*C are disposed in a manner that the front end edges thereof are aligned on a focal line FL and the special light emitting chip 112*a*B located at the center portion is disposed on the optical axis Ax. The three general light emitting chips 112*a*D, 112*a*E, 112*a*F are disposed so as to be adjacent to these three special light emitting chips 112*a*A, 112*a*B, 112*a*C on the backward side thereof, respectively. Further, the remaining three general light emitting chips 112*a*G, 112*a*H, 112*a*I are disposed so as to be adjacent to these three general light emitting chips 112*a*D, 112*a*E, 112*a*F on the backward side thereof, respectively.

The light emitting element 112 is lighted in three lighting modes. That is, the light emitting element has a first lighting mode in which the three special light emitting chips 112*a*A, 112*a*B, 112*a*C are lighted simultaneously as shown by hatched areas in FIG. 7A, a second lighting mode in which the three special light emitting chips 112*a*A, 112*a*B, 112*a*C and the three general light emitting chips 112*a*D, 112*a*E, 112*a*F on a second row are lighted simultaneously as shown by hatched areas in FIG. 7B, and a third lighting mode in which the three special light emitting chips 112*a*A, 112*a*B, 112*a*C, the three general light emitting chips 112*a*D, 112*a*E, 112*a*F on the second row and the three general light emitting chips 112*a*G, 112*a*H, 112*a*I on a third row are lighted simultaneously as shown by hatched areas in FIG. 7C.

In FIG. 6, an optical path of light emitted from the special light emitting chip 112*a*B located at the center portion is shown.

Figure 8A:
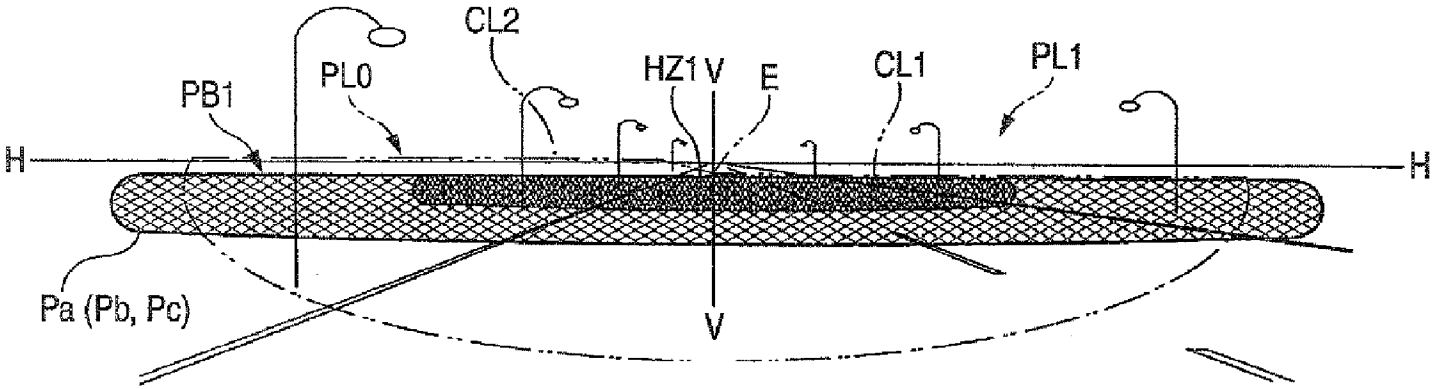
Figure 8B:
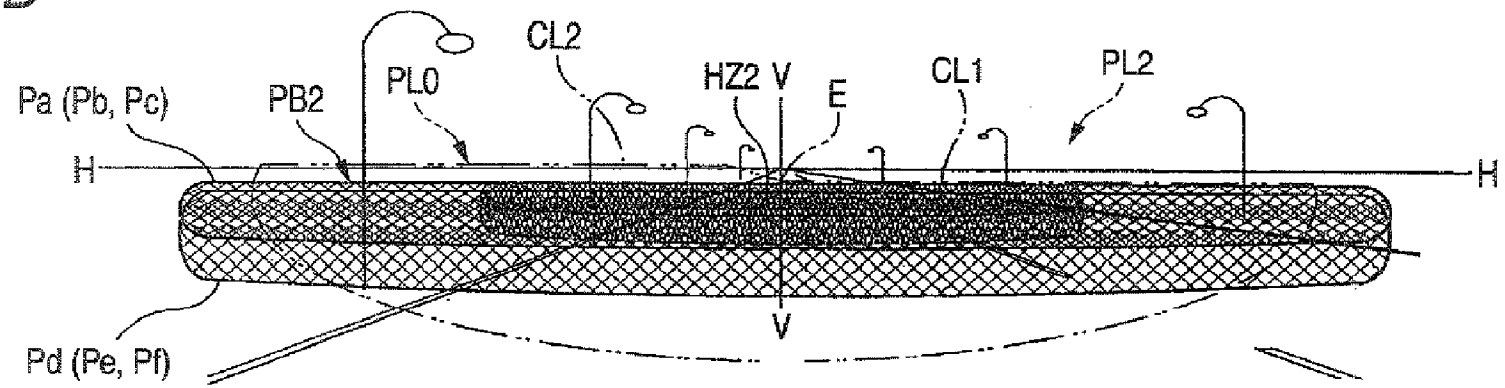
Figure 8C:
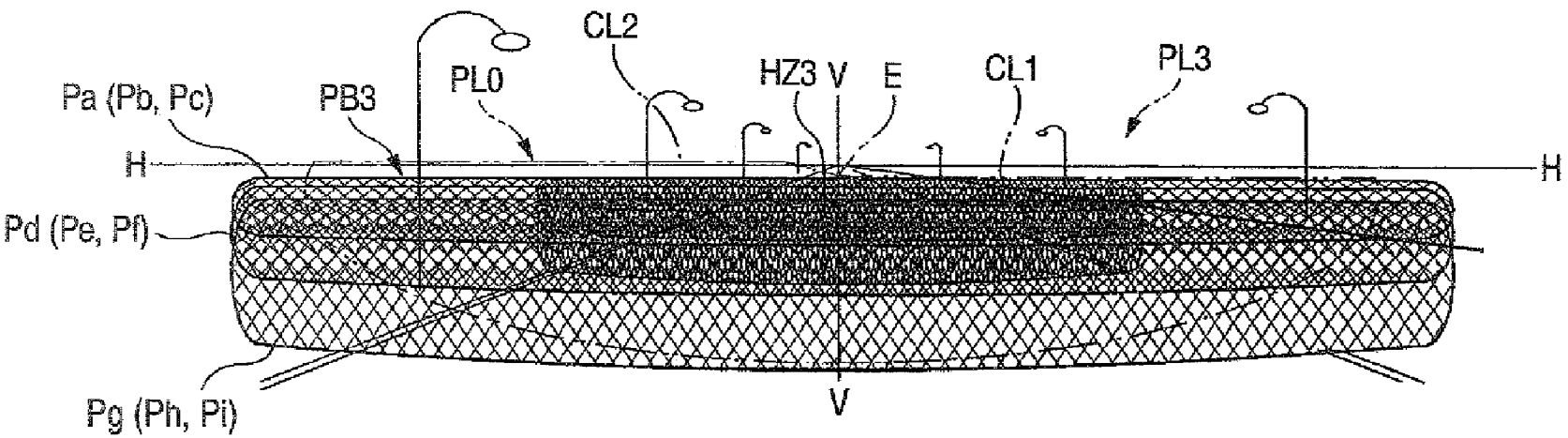

FIGS. 8A to 8C are perspective views each showing a light distribution pattern formed on an imaginary vertical screen placed 25 m ahead from the lamp by light irradiated in the forward direction from the vehicular headlamp unit 110 according to the second exemplary embodiment. In this case, FIG. 8A shows a light distribution pattern PB1 formed by the first lighting mode, FIG. 8B shows a light distribution pattern PB2 formed by the second lighting mode, and FIG. 8C shows a light distribution pattern PB3 formed by the third lighting mode.

As shown in these figures, these light distribution patterns PB1, PB2, PB3 are composed with a basic light distribution pattern PL0 shown by a two-dot chain line in the figure to form low-beam light distribution patterns PL1, PL2, PL3, respectively.

As shown in FIG. 8A, the light distribution pattern PB1 is formed as a composite light distribution pattern of three light distribution patterns Pa, Pb, Pc each having almost the same configuration respectively formed by emitting lights from the special light emitting chips 112*a*A, 112*a*B, 112*a*C simultaneously lighted in the first lighting mode.

The light distribution pattern PB1 is a light distribution pattern prolonged extending sideways, which extends largely on both the left and right sides uniformly around the V-V line beneath the H-H line, and the upper end edge thereof is formed so as to almost coincide with the opposite lane side cutoff line CL1. In this case, the light distribution pattern PB1 is formed as a light distribution pattern having a narrow vertical width, and the high intensity area HZ1 thereof is formed so as to extend in a long and narrow manner in the left and right directions around the V-V line at a vicinity of a lower side of the elbow point E. The light distribution pattern PB1 is quite similar to the light distribution pattern PA1 shown in FIG. 5A.

As shown in FIG. 8B, the light distribution pattern PB2 is formed as a composite light distribution pattern of three light distribution patterns Pd, Pe, Pf each having almost the same configuration respectively formed by emitting lights from the three general light emitting chips 112*a*D, 112*a*E, 112*a*F additionally lighted in the second lighting mode and the three light distribution patterns Pa, Pb, Pc.

In this case, since the light distribution patterns Pd, Pe, Pf are formed by the emitting lights from the three general light emitting chips 112*a*D, 112*a*E, 112*a*F adjacent on the backward side of the special light emitting chips 112*a*A, 112*a*B, 112*a*C, respectively, these light distribution patterns Fd, Pe, Pf have shapes which are formed by slightly shifting the light distribution patterns Pa, Pb, Pc downward and slightly widening these light distribution patterns Pa, Pb, Pc downward, respectively.

Like the light distribution pattern PB1, this light distribution pattern PB2 is a light distribution pattern prolonged extending sideways, which extends largely on both the left and right sides uniformly around the V-V line beneath the H-H line, and the upper end edge thereof is formed so as to almost coincide with the opposite lane side cutoff line CL1. However, since the light distribution pattern PB2 is formed as the composite light distribution pattern of the light distribution patterns Pa, Pb, Pc, Pd, Pe, Pf, this light distribution pattern has a larger vertical width to some extent and is more bright as compared with the light distribution pattern PB1, and a high intensity area HZ2 thereof is formed to extend in a long and narrow manner in the left and right directions around the V-V line at a vicinity of a lower side of the elbow point E but to have a vertical width larger than that of the high intensity area HZ1 of the light distribution pattern PB1 to some extent.

As shown in FIG. 8C, the light distribution pattern PB3 is formed as a composite light distribution pattern of three light distribution patterns Pg, Ph, Pi each having almost the same configuration respectively formed by emitting lights from the three general light emitting chips 112*a*G, 112*a*H, 112*a*I additionally lighted in the third lighting mode and the six light distribution patterns Pa, Pb, Pc, Pd, Pe, Pf.

In this case, since the light distribution patterns Pg, Ph, Pi are formed by the emitting lights from the three general light emitting chips 112*a*G, 112*a*H, 112*a*I adjacent on the backward side of the general light emitting chips 112*a*D, 112*a*E, 112*a*F, respectively, these light distribution patterns Pg, Ph, Pi have shapes which are formed by slightly shifting the light distribution patterns Pd, Pe, Pf downward and further slightly widening these light distribution patterns Pd, Pe, Pf downward, respectively.

Like the light distribution patterns PB1 and PB2, this light distribution pattern PB3 is a light distribution pattern prolonged extending sideways, which extends largely on both the left and right sides uniformly around the V-V line beneath the H-H liner and the upper end edge thereof is formed so as to almost coincide with the opposite lane side cutoff line CL1. However, since the light distribution pattern PB3 is formed as the composite light distribution pattern of the light distribution patterns Pa, Pb, Pc, Pd, Pe, Pf, Pg, Ph, Pi, this light distribution pattern has a quite larger vertical width and is quite bright as compared with the light distribution pattern PB1, and a high intensity area HZ3 thereof is formed to extend in a long and narrow manner in the left and right directions around the V-V line at a vicinity of a lower side of the elbow point E but to have a vertical width quite larger than that of the high intensity area HZ1 of the light distribution pattern PB1. This light distribution pattern PB3 has a brightness three times as large as that of the light distribution pattern PB2 shown in FIG. 5B.

As described in detail, the vehicular lamp unit 110 according to the second exemplary embodiment is arranged in a manner that the reflection surface 14*a* of the reflector 14 is configured by the parabolic cylindrical plane extending in the horizontal direction orthogonal to the optical axis Ax, and the light emitting element 112 has the first lighting mode in which, of the nine light emitting chips 12*a* arranged in the 3×3 matrix arrangement, the three special light emitting chips 12*a*A, 12*a*B, 12*a*C which front end edges are aligned on the focal line FL of the parabolic cylindrical plane are lighted simultaneously, the second lighting mode in which the three general light emitting chips 112*a*D, 112*a*E, 112*a*F on the second row are additionally lighted simultaneously, and the third lighting mode in which the three general light emitting chips 112*a*G, 112*a*H, 112*a*I on the third row are additionally lighted simultaneously, whereby the vehicular lamp unit has the following actions and effects.

That is, the first lighting mode can form the light distribution pattern PB1 of the long and narrow shape in which the vertical width thereof is small and the upper end portion thereof is relatively bright. As a result, a long distance area on the road surface ahead of the vehicle can be irradiated efficiently and widely in the left and right directions thereby to enhance the visibility in a distant area, whereby the first lighting mode can be suitable for a high vehicle speed.

The second lighting mode can form the light distribution pattern PB2 of the long and narrow shape, so as to enhance the light distribution pattern PB1, in which the vertical width thereof is large and the upper end portion thereof is relatively bright. As a result, the road surface ahead of the vehicle can be irradiated widely and brightly in the left and right directions from an intermediate area to a distant area, whereby the second lighting mode can be further suitable for an urban area, or traveling in a mountainous area having many curved roads.

Further, the third lighting mode can form the light distribution pattern PB3 of the long and narrow shape, so as to enhance the light distribution pattern PB1, in which the vertical width thereof is quite large and the upper end portion thereof is relatively bright. As a result, the road surface ahead of the vehicle can be irradiated widely and brightly in the left and right directions from a near area to a distant area, whereby the second lighting mode can be further suitable for an urban area, or traveling a mountainous area having many curved roads.

According to the vehicular lamp unit 110 of the second exemplary embodiment thus configured, each of the light distribution patterns PB1, PB2, PB3 formed by the irradiation light from the vehicular lamp unit can be suitably changed in accordance with the running state of the vehicle.

In this exemplary embodiment, since the low-beam light distribution patterns PL1, PL2, PL3 are formed as the composite light distribution patterns of the light distribution patterns PB1, PB2, PB3 formed by the irradiation lights from the vehicular lamp unit 110 and the basic light distribution pattern PL0 formed by the irradiation lights from another vehicular lamp unit, respectively, the light distribution pattern for a low beam can be suitably changed in accordance with the running state of the vehicle.

Next, the third exemplary embodiment of the invention will be explained.

Figure 9B:
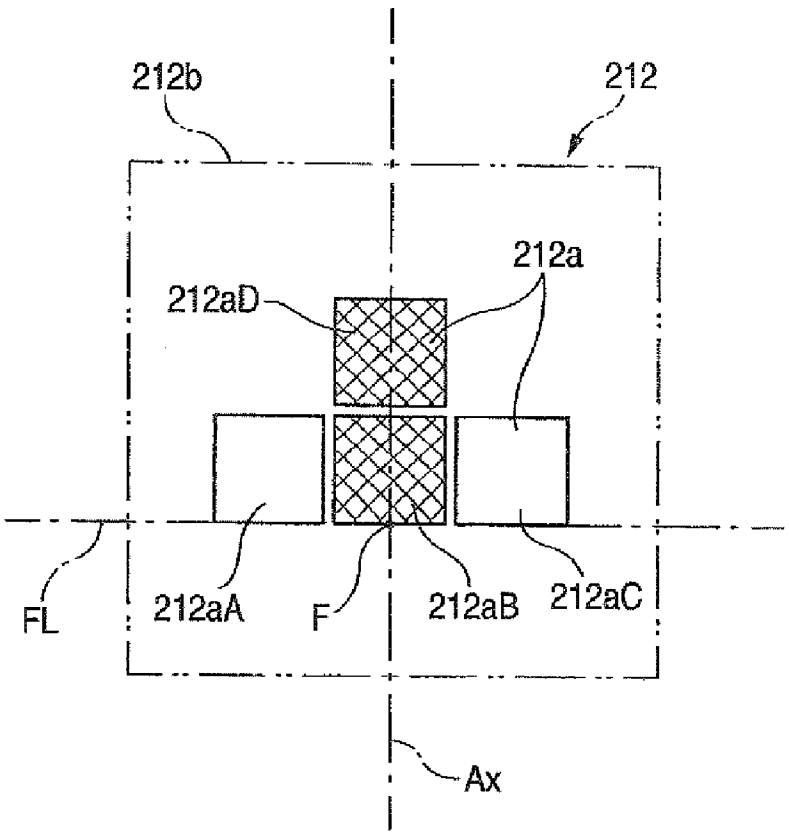
FIGS. 9A and 9B are diagrams showing a main portion of a vehicular lamp unit according to a third exemplary embodiment of the present invention and is similar to FIGS. 3A and 3B.
Figure 9A:
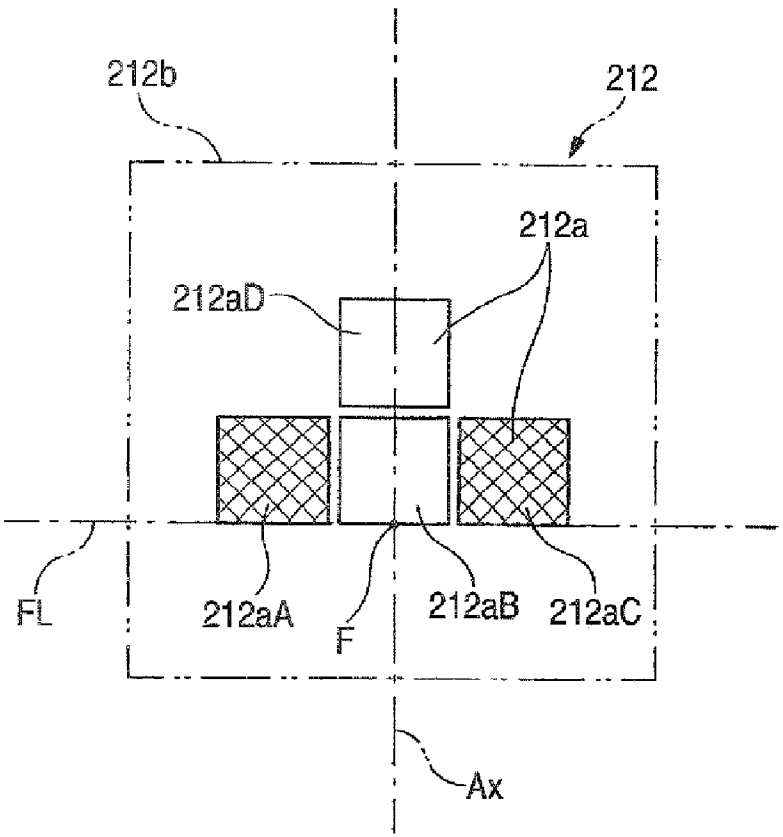

FIGS. 9A and 9B are diagrams showing a main portion of a vehicular lamp unit according to this exemplary embodiment and is similar to FIG. 3.

As shown in this figure, the vehicular lamp unit according to this exemplary embodiment is the same in its basic configuration as that of the vehicular lamp unit 10 of the first exemplary embodiment but differs from the first exemplary embodiment in the number and the arrangement of the light emitting chips 212*a* of a light emitting element 212.

That is, like the light emitting element 12 of the first exemplary embodiment, the light emitting element 212 is a white light emitting diode and is configured in a manner that four light emitting chips 212*a* are mounted on a board 212*b* in a T-shaped arrangement so as to be adjacent to each other with a small interval. In this case, each of the light emitting chips 212*a* has a slightly-large light emission surface of a square shape each side of which has about a 1.3 mm length. The light emission surface is sealed by a thin film. Each of these light emitting chips 212*a* has a light emission quantity larger than that of the light emitting element 12 of the first exemplary embodiment by a quantity corresponding to a difference between the light emission surface areas of the light emitting elements of the first exemplary embodiment and the third exemplary embodiment.

Of the four light emitting chips 112*a*, each of the three light emitting chips 212*a*A, 212*a*B, 212*a*C located at the front row constitutes a special light emitting chip and the remaining one light emitting chip 212*a*D constitutes a general light emitting chip.

The three special light emitting chips 212*a*A, 212*a*B, 212*a*C are disposed in a manner that the front end edges thereof are aligned on a focal line FL and the special light emitting chip 212*a*B located at the center portion is disposed on the optical axis Ax. The general light emitting chip 212*a*D is disposed so as to be adjacent to the backward side of the special light emitting chip 212*a*B located at the center portion.

As lighting modes, the light emitting element 12 has a first lighting mode in which a pair of the left and right special light emitting chips 212*a*A, 212*a*C are lighted simultaneously as shown by hatched areas in FIG. 9A and a second lighting mode in which the special light emitting chip 212*a*B located at the center portion and the general light emitting chip 212*a*D are lighted simultaneously as shown by hatched areas in FIG. 9B.

Figure 10A:
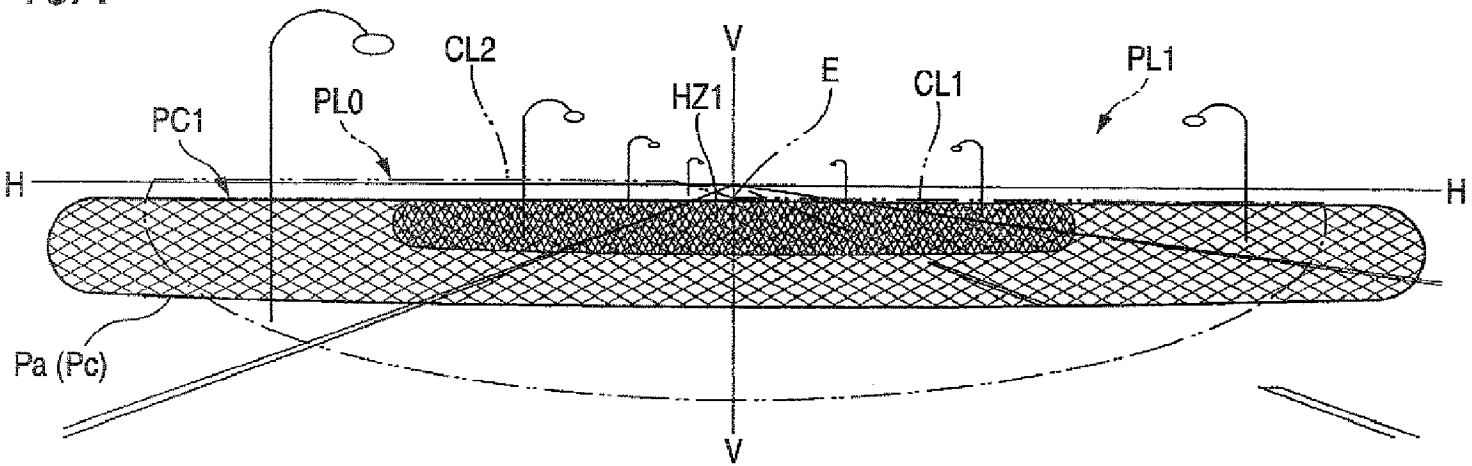
Figure 10B:
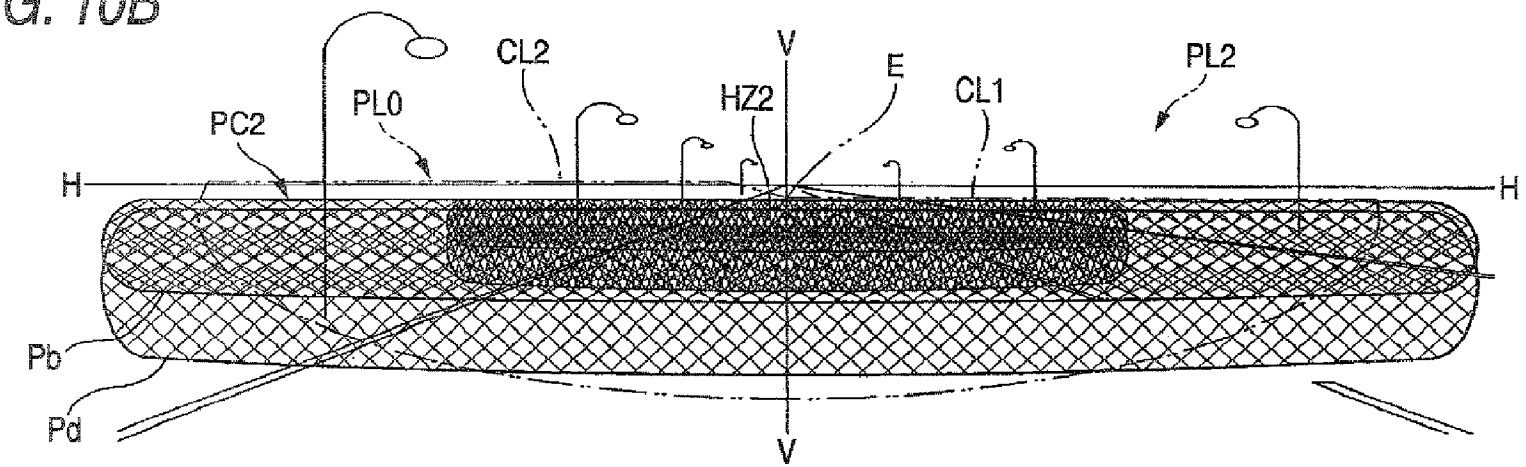

FIGS. 10A and 10B are perspective views each showing a light distribution pattern formed on an imaginary vertical screen placed 25 m ahead from the lamp by light irradiated in the forward direction from the vehicular headlamp unit according to the third exemplary embodiment. In this case, FIG. 10A shows a light distribution pattern PC1 formed by the first lighting mode and FIG. 10B shows a light distribution pattern PC2 formed by the second lighting mode.

As shown in these figures, these light distribution patterns PC1, PC2 are composed with a basic light distribution pattern PL0 shown by a two-dot chain line in the figure to form low-beam light distribution patterns PL1, PL2, respectively.

As shown in FIG. 10A, the light distribution pattern PC1 is formed as a composite light distribution pattern of two light distribution patterns Pa, Pc each having almost the same configuration respectively formed by emitting lights from the special light emitting chips 212*a*A, 212*a*C simultaneously lighted in the first lighting mode.

The light distribution pattern PC1 is a light distribution pattern prolonged extending sideways, which extends largely on both the left and right sides uniformly around the V-V line beneath the H-H line, and the upper end edge thereof is formed so as to almost coincide with the opposite lane side cutoff line CL1. In this case, the light distribution pattern PC1 is formed as a light distribution pattern having a relatively narrow vertical width, and the high intensity area HZ1 thereof is formed so as to extend in a long and narrow manner in the left and right directions around the V-V line at a vicinity of a lower side of the elbow point E. The light distribution pattern PC1 has a shape which is formed by slightly widening the light distribution pattern PA1 shown in FIG. 5A downward.

As shown in FIG. 10B, the light distribution pattern PC2 is formed as a composite light distribution pattern of the light distribution pattern Pb formed by emitting light from the special light emitting chip 212*a*B additionally lighted in the second lighting mode and the light distribution pattern Pd formed by emitting light from the general light emitting chip 212*a*D.

In this case, since the light distribution pattern Pd is formed by the emitting light from the general light emitting chip 212*a*D adjacent on the backward side of the special light emitting chip 212*a*B, the light distribution pattern has a shape which is formed by slightly shifting the light distribution pattern Pd downward and slightly widening this light distribution pattern Pd downward.

Similar to the light distribution pattern PC1, this light distribution pattern PC2 is a light distribution pattern prolonged extending sideways, which extends largely on both the left and right sides uniformly around the V-V line beneath the H-H line, and the upper end edge thereof is formed so as to almost coincide with the opposite lane side cutoff line CL1. However, since the light distribution pattern PC2 is formed as the composite light distribution pattern of the light distribution patterns Pb, Pd, this light distribution pattern has a larger vertical width to some extent and is more bright as compared with the light distribution pattern PC1, and a high intensity area HZ2 thereof is formed to extend in a long and narrow manner in the left and right directions around the V-V line at a vicinity of a lower side of the elbow point E but to have a vertical width larger than that of the high intensity area HZ1 to some extent. The light distribution pattern PC2 has almost the same size and almost the same brightness as those of the light distribution pattern PA2 shown in FIG. 5B.

As described in detail, the vehicular lamp unit 10 according to the third exemplary embodiment has the first lighting mode in which, of the four light emitting chips 212*a* of the light emitting element 212 arranged in the T-shape, the pair of the left and right special light emitting chips 212*a*A, 212*a*C of the three special light emitting chips 212*a*A, 212*a*B, 212*a*C which front end edges are aligned on the focal line FL of the parabolic cylindrical plane are lighted simultaneously and the second lighting mode in which the special light emitting chip 212*a*B located at the center portion of the three special light emitting chips 212*a*A, 212*a*B, 212*a*C and the general light emitting chip 212*a*D adjacent on the backward side thereof are lighted simultaneously, whereby the vehicular lamp unit has the following actions and effects.

That is, the first lighting mode can form the light distribution pattern PC1 of the long and narrow shape in which the vertical width thereof is relatively small and the upper end portion thereof is relatively bright. As a result, a long distance area on the road surface ahead of the vehicle can be irradiated efficiently and widely in the left and right directions thereby to enhance the visibility in a distant area, whereby the first lighting mode can be suitable for a high vehicle speed.

The second lighting mode can form the light distribution pattern PC2 of the long and narrow shape, so as to enhance the light distribution pattern PA1, in which the vertical width thereof is large and the upper end portion thereof is relatively bright. As a result, the road surface ahead of the vehicle can be irradiated widely and brightly in the left and right directions from an intermediate area to a distant area, whereby the second lighting mode can be suitable for an urban area, or traveling a mountainous area having many curved roads.

According to the vehicular lamp unit of the third exemplary embodiment thus configured, each of the light distribution patterns PC1, PC2 formed by the irradiation light from the vehicular lamp unit can be suitably changed in accordance with the running state of the vehicle.

In this exemplary embodiment, since the low-beam light distribution patterns PL1, PL2 are formed as the composite light distribution patterns of the light distribution patterns PC1, PC2 formed by the irradiation lights from the vehicular lamp unit and the basic light distribution pattern PL0 formed by the irradiation lights from another vehicular lamp unit, respectively, the light distribution pattern for a low beam can be suitably changed in accordance with the running state of the vehicle.

In this exemplary embodiment, although an amount of consumption power of each of the light emitting chips 212*a* is slightly large, since the number of the light emitting chips 212*a* simultaneously lighted in each of the first and second lighting modes is only two, an amount of consumption power of the light emitting element 212 can be suppressed. Further, since the different light emitting chips 212*a* are simultaneously lighted in the first and second lighting modes, a life time of the light emitting element 212 can be elongated.

Next, the fourth exemplary embodiment of the invention will be explained.

Figure 11:
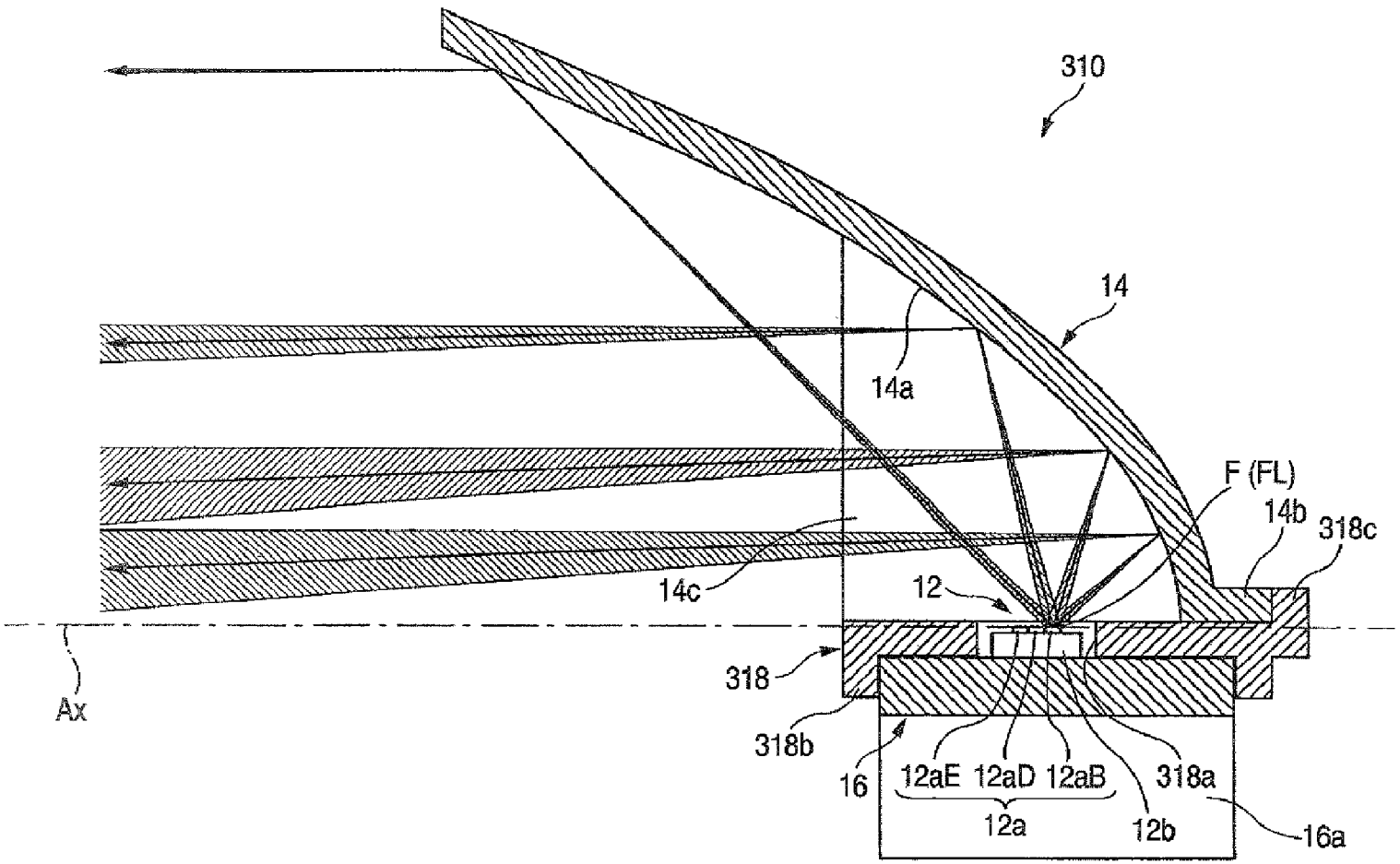
FIG. 11 is a diagram showing the vehicular lamp unit according to a fourth exemplary embodiment of the present invention and is similar to FIG. 1.

FIG. 11 shows a vehicular lamp unit 310 according to this exemplary embodiment and is similar to FIG. 1.

As shown in this figure, the vehicular lamp unit 310 according to this exemplary embodiment has such a configuration that the vehicular lamp unit 10 according to the first exemplary embodiment is disposed upside down with respect to the optical axis Ax and the light emitting element 12 is reversed in the forward and backward direction with respect to the focal line FL.

That is, the light emitting element 12 according to the fourth exemplary embodiment is disposed so as to be directed upward on the optical axis Ax and the reflector 14 is disposed on the upper side of the light emitting element 12.

The five light emitting chips 12*a* of the light emitting element 12 are disposed in a manner that three special light emitting chips 12*a*A, 12*a*B, 12*a*C located at the backmost row are aligned at their rear end edges on a focal line FL.

A holder 318 according to the fourth exemplary embodiment is arranged in a manner that a rear end flange portion 318*c* thereof is same as that of the first exemplary embodiment, but the forming positions of an opening portion 318*a* and an annular flange portion 318*b* thereof differ from those of the first exemplary embodiment.

Also in the fourth exemplary embodiment, almost all of emitting light emitted from each of the light emitting chips 12*a* is incident on the reflection surface 14*a* of the reflector 14. Since the reflection surface 14*a* is configured as a parabolic cylindrical plane extending in the horizontal directions the emitting light from each of the light emitting chips 12*a* incident on the reflection surface 14*a* is reflected by the reflection surface 14*a* and then irradiated in the forward direction as light which scarcely diffuses in the vertical direction but diffuses largely in the horizontal direction.

Since the special light emitting chip 12*a*B located at the center portion of the three special light emitting chips 12*a*A, 12*a*B, 12*a*C is disposed in a manner that the rear end edge thereof is located on the focal line FL on the optical axis Ax, the light emitted from the rear end edge thereof is reflected on the reflection surface 14*a* and then directed in a direction in parallel to the optical axis Ax with respect to the vertical direction. Light emitted from the front end edge of the special light emitting chip 12*a*B is reflected downward with respect to the optical axis Ax by an angle corresponding to the width of the light emitting chip 12*a* in the front and rear directions, and light emitted from the light emission center of the special light emitting chip 12*a*B is directed downward by an angle almost half of the aforesaid angle. The light from the special light emitting chip 12*a*B is reflected by the reflection surface 14*a* with an open angle which becomes smaller as the reflection point approaches the upper end edge of the reflection surface 14*a*. Further, the light rays emitted from the special light emitting chip 12*a*B are reflected by the respective points of the reflection surface 14*a* and diffuse largely on both the left and right sides of the optical axis Ax uniformly with respect to the horizontal direction.

Optical paths of light emitted from each of the special light emitting chips 12*a*A, 12*a*C located on both the left and right sides of the special light emitting chip 12*a*B are formed in a similar manner as those of the special light emitting chip 12*a*B.

Light emitted from the general light emitting chip 12*a*D adjacent to the special light emitting chip 12*a*B on the front side thereof is reflected downward on the reflection surface 14*a* by an angle corresponding to the pitch between the light emission centers of these light emitting chips 12*a*B, 12*a*D as compared with the emitting light from the special light emitting chip 12*a*B. Light emitted from the general light emitting chip 12*a*E adjacent to the general light emitting chip 12*a*D on the front side thereof is reflected further downward on the reflection surface 14*a* by an angle corresponding to the pitch between the light emission centers of these light emitting chips 12*a*D, 12*a*E as compared with the emitting light from the general light emitting chip 12*a*D.

As the lighting modes of the light emitting element 12, the vehicular lamp unit 310 according to the fourth exemplary embodiment also has a first lighting mode in which the three special light emitting chips 12*a*A, 12*a*B, 12*a*C are lighted simultaneously and a second lighting mode in which the special light emitting chip 12*a*B located at the center portion and the remaining two general light emitting chips 12*a*D, 12*a*E are lighted simultaneously.

As described in detail, the vehicular lamp unit 310 according to the fourth exemplary embodiment is also configure to irradiate light almost in the similar manner as the vehicular lamp unit 10 according to the first exemplary embodiment and have the first and second lighting modes, so that the vehicular lamp unit according to the fourth exemplary embodiment has actions and effects similar to those of the first exemplary embodiment.

Next, the fifth exemplary embodiment of the invention will be explained.

Figure 12:
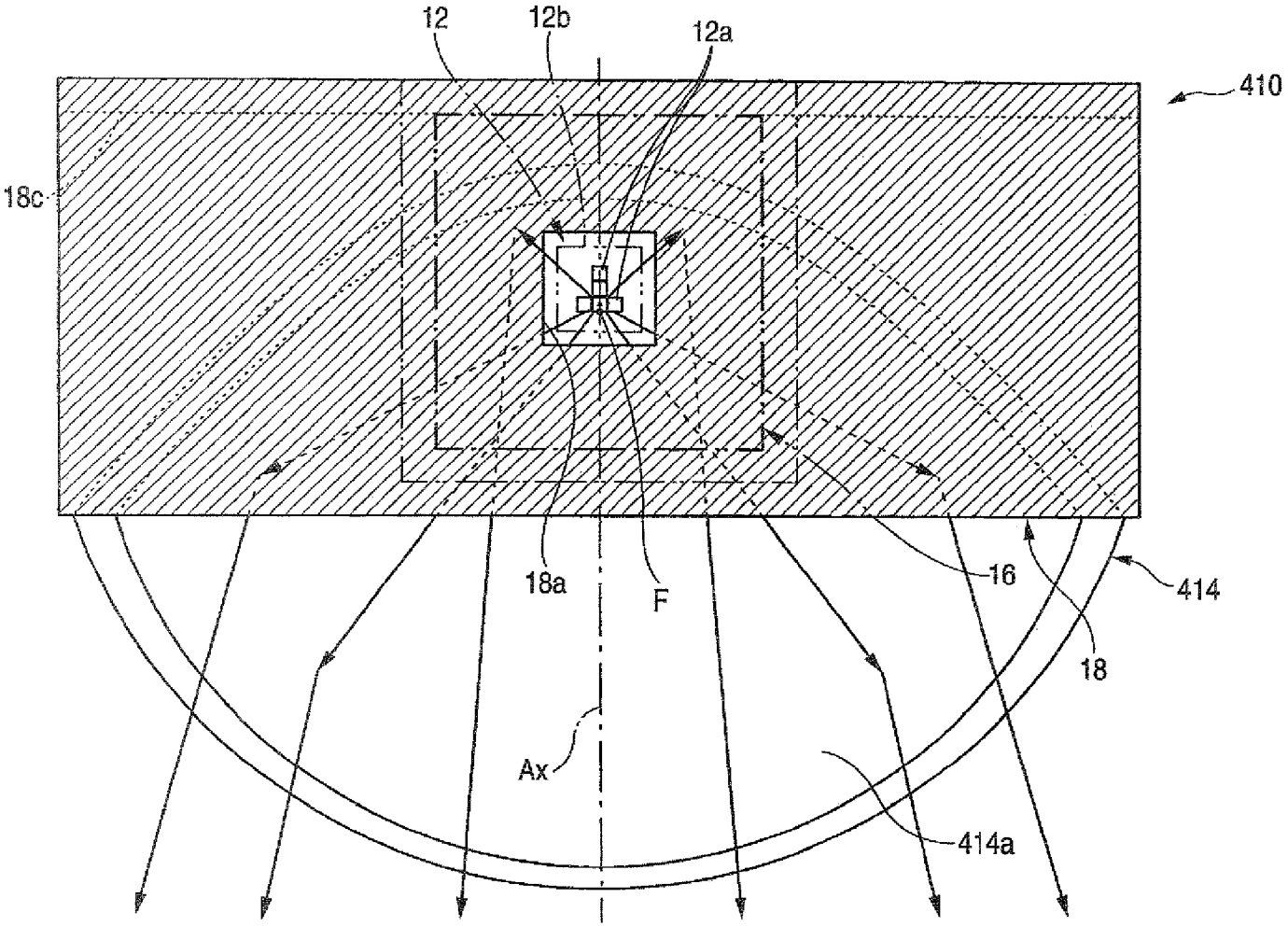
FIG. 12 is a diagram showing the vehicular lamp unit according to a fifth exemplary embodiment of the present invention and is similar to FIG. 2.

FIG. 12 shows a vehicular lamp unit 410 according to this exemplary embodiment and is similar to FIG. 2.

As shown in this figure, the vehicular lamp vehicular lamp unit 410 according to the exemplary embodiment is similar in its basic configuration as that of the vehicular lamp unit 10 of the first exemplary embodiment but differs from the first exemplary embodiment in the shape of the reflection surface 414*a* of the reflector 414.

That is, the reflection surface 414*a* of the reflector 414 according to the fifth exemplary embodiment is same as the reflection surface 14*a* of the reflector 14 in a point that the its section thereof along the vertical plane including the optical axis Ax thereof is configured by a parabolic shape having the optical axis Ax as an axis thereof and a focal point F on the optical axis Ax but differs from the reflection surface 14*a* of the first embodiment in a point that a section of the reflection surface along the horizontal plane is configured by a hyperbolic curve having the optical axis Ax as an axis thereof and a focal point F on the optical axis Ax.

Thus, the emitting light from each of the light emitting chips 12*a* incident on the reflection surface 414*a* is reflected by the reflection surface 414*a* and then irradiated in the forward direction as light which scarcely diffuses in the vertical direction but diffuses to some extent on both the left and right sides of the optical axis Ax.

Also according to the fifth exemplary embodiment, the light emitting element 12 is lighted by two lighting modes, that is, a first lighting mode in which the three special light emitting chips 12*a*A, 12*a*B, 12*a*C are simultaneously lighted as shown by hatched areas in FIG. 3A in the case of the first embodiment and a second lighting mode in which the special light emitting chip 12$a$B located at the center portion and the two general light emitting chips 12$a$D, 12$a$E are lighted simultaneously as shown by hatched areas in FIG. 3B.

Figure 13A:
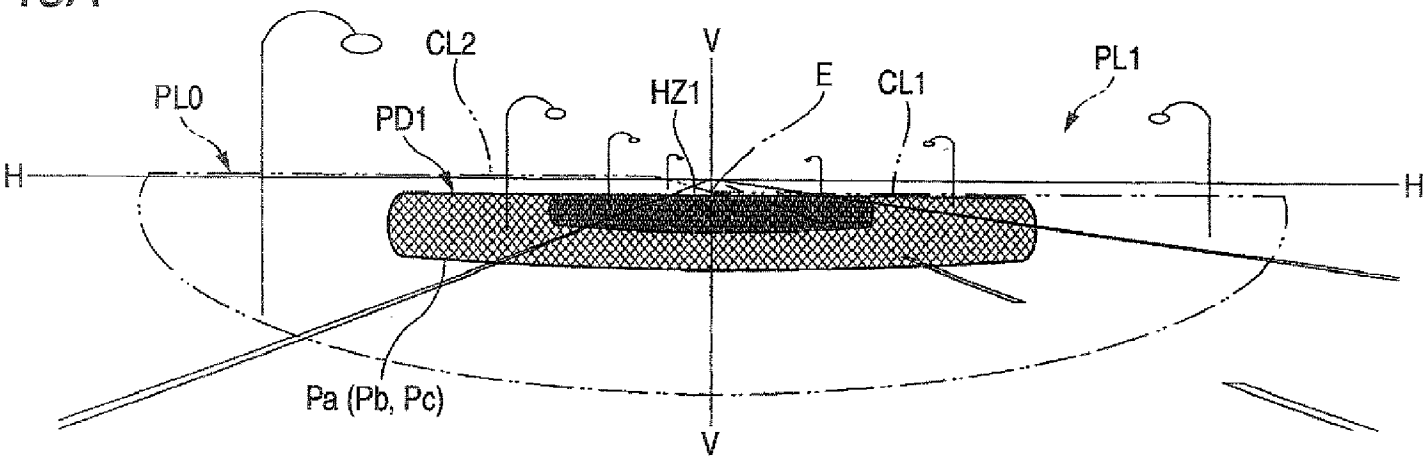
Figure 13B:
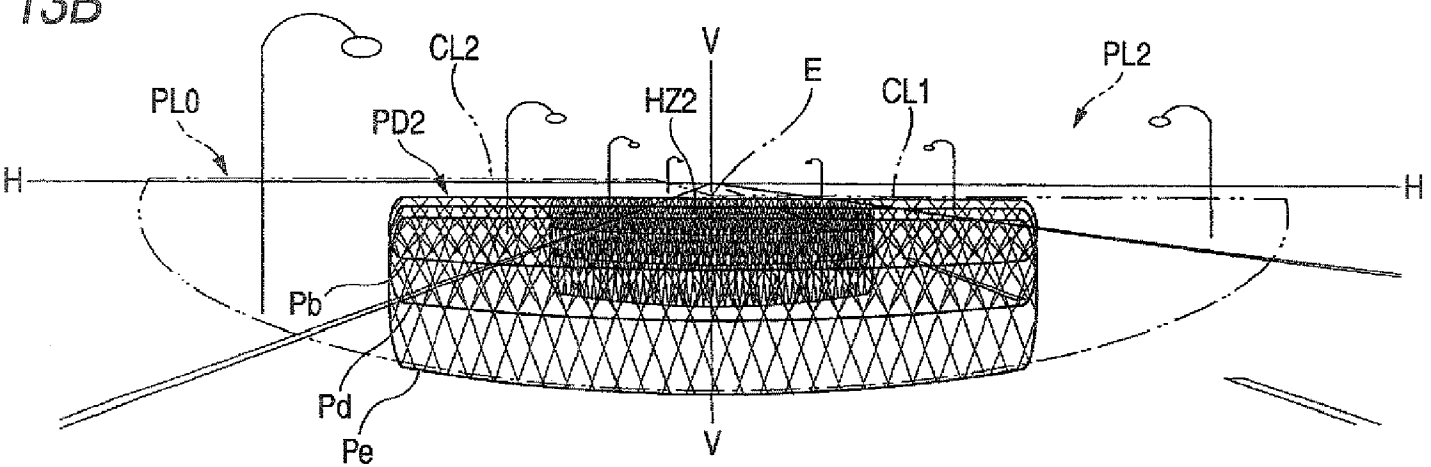

FIGS. 13A and 13B are perspective views each showing a light distribution pattern formed on an imaginary vertical screen placed 25 m ahead from the lamp by light irradiated in the forward direction from the vehicular headlamp unit 410 according to the embodiment. In this case, FIG. 13A shows a light distribution pattern PD1 formed by the first lighting mode and FIG. 13B shows a light distribution pattern PD2 formed by the second lighting mode.

As shown in these figures, these light distribution patterns PD1, PD2 are composed with a basic light distribution pattern PL0 shown by a two-dot chain line in the figure to form low-beam light distribution patterns PL1, PL2, respectively.

As shown in FIG. 13A, the light distribution pattern PD1 is formed as a composite light distribution pattern of two light distribution patterns Pa, Pb, Pc each having almost the same configuration respectively formed by emitting lights from the three special light emitting chips 12$a$A, 12$a$B, 12$a$C simultaneously lighted in the first lighting mode.

The light distribution pattern PD1 is a light distribution pattern prolonged extending sideways, which extends to an intermediate degree on both the left and right sides uniformly around the V-V line beneath the H-H line, and the upper end edge thereof is formed so as to almost coincide with the opposite lane side cutoff line CL1. In this case, the light distribution pattern PD1 is formed as a light distribution pattern having a narrow vertical width, and the high intensity area HZ1 thereof is formed so as to extend in a long and narrow manner in the left and right directions around the V-V line at a vicinity of a lower side of the elbow point E. This light distribution pattern PD1 is a light distribution pattern in which each of left and right diffusion angles is made relatively small to some extent with respect to the light distribution pattern PA1 shown in FIG. 5A to increase the entire brightness by a quantity corresponding to the angle thus made smaller.

As shown in FIG. 13B, the light distribution pattern PD2 is formed as a composite light distribution pattern of three light distribution patterns Pd, Pe, Pf each having almost the same configuration respectively formed by emitting lights from the three general light emitting chips 112$a$D, 112$a$E, 112$a$F additionally lighted in the second lighting mode and the three light distribution patterns Pa, Pb, Pc.

In this case, since the light distribution patterns Pd, Pe, Pf are formed by the emitting lights from the three general light emitting chips 12$a$D, 12$a$E, 12$a$F adjacent on the backward side of the special light emitting chips 12$a$A, 12$a$B, 12$a$C, respectively, these light distribution patterns Pd, Pe, Pf have shapes which are formed by slightly shifting the light distribution patterns Pa, Pb, Pc downward and slightly widening these light distribution patterns Pa, Pb, Pc downward, respectively.

Like the light distribution pattern PD1, this light distribution pattern PD2 is a light distribution pattern prolonged extending sideways, which extends to an intermediate degree on both the left and right sides uniformly around the V-V line beneath the H-H line, and the upper end edge thereof is formed so as to almost coincide with the opposite lane side cutoff line CL1. However, since the light distribution pattern PD2 is formed as the composite light distribution pattern of the light distribution patterns Pa, Pb, Pc, Pd, Pe, Pf, this light distribution pattern has a larger vertical width as compared with the light distribution pattern PD1, and a high intensity area HZ2 thereof is formed to extend in a long and narrow manner in the left and right directions around the V-V line at a vicinity of a lower side of the elbow point E but to have a vertical width larger than that of the high intensity area HZ1 of the light distribution pattern PD1. This light distribution pattern PD2 is a light distribution pattern in which each of left and right diffusion angles is made relatively small to some extent with respect to the light distribution pattern PA2 shown in FIG. 5B to increase the entire brightness by a quantity corresponding to the angle thus made smaller.

As described in detail, the vehicular lamp unit 410 according to the fifth exemplary embodiment is arranged in a manner that the reflection surface 414$a$ of the reflector 414 thereof is configured by the parabolic shape in its vertical section and the hyperbolic curve in its horizontal section, and the light emitting element 12 has the first lighting mode in which, of the five light emitting chips 12$a$ arranged in the T-shape, the three special light emitting chips 12$a$A, 12$a$B, 12$a$C which front end edges are aligned on the axial line passing through the focal point F and extending in the horizontal direction orthogonal to the optical axis Ax are lighted simultaneously and the second lighting mode in which the special light emitting chip 12$a$B located at the center portion of the three special light emitting chips and the remaining two general light emitting chips 12$a$D, 12$a$E are lighted simultaneously, whereby the vehicular lamp unit has the following actions and effects.

That is, the first lighting mode can form the light distribution pattern PD1 of the long and narrow shape in which the vertical width thereof is small and the upper end portion thereof is relatively bright. As a result, a long distance area on the road surface ahead of the vehicle can be irradiated efficiently with a certain degree of the vertical width in the left and right directions thereby to enhance the visibility in a distant area, whereby the first lighting mode can be suitable for a high vehicle speed.

The second lighting mode can form the light distribution pattern PD2 of the long and narrow shape in which the vertical width thereof is large and the upper end portion thereof is relatively bright. As a result, the road surface ahead of the vehicle can be irradiated in the left and right directions with a certain degree of the vertical width from a near area to a distant area, whereby the second lighting mode can be suitable for an urban area.

In this manner, according to the vehicular lamp unit 410 of the embodiment thus configured, each of the light distribution patterns PD1, PD2 formed by the irradiation light from the vehicular lamp unit can be suitably changed in accordance with the running state of the vehicle.

In the fifth exemplary embodiment, since the low-beam light distribution patterns PL1, PL2 are formed as the composite light distribution patterns of the light distribution patterns PD1, PD2 formed by the irradiation lights from the vehicular lamp unit 410 and the basic light distribution pattern PL0 formed by the irradiation lights from another vehicular lamp unit, respectively, the light distribution pattern for a low beam can be suitably changed in accordance with the running state of the vehicle.

In particular, in this exemplary embodiment, since each of the left and right diffusion angles of the light distribution patterns PD1, PD2 is set to an intermediate value, the entire brightness of the lamp unit can be increased.

Further, in this exemplary embodiment, since the horizontal section of the reflection surface 414$a$ of the reflector 414 is formed by the hyperbolic curve, more emitting light from the respective light emitting chips 12$a$ can be incident on the reflection surface 414$a$, whereby the utilizing factor of the light fluxes of the light source can be further enhanced.

Further, in this exemplary embodiment, also the number of the light emitting chips 12*a* simultaneously lighted in each of the first and second lighting modes is suppressed to a relatively small number, that is, three, an amount of consumption power of the light emitting element 12 can be suppressed.

In each of the above-described exemplary embodiments, although the explanation is made that the shaft of the parabolic shape constituting the vertical section of each of the refection surfaces 14*a*, 414*a* of the reflectors 14, 414 coincides with the optical axis Ax, the shaft may be set to extend in a direction slightly slanted in the upper or lower direction with respect to the optical axis Ax.

Numerical values shown as data in the respective exemplary embodiments are mere example and the data may of course be set suitably to different values.

While the invention has been described with respect to a limited number of exemplary embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicular lamp unit comprising:

a light emitting element, which is disposed on an optical axis extending in forward and backward directions of the lamp unit so as to be directed downward, and which has a plurality of light emitting chips disposed with a predetermined arrangement so as to be adjacent to each other; and a reflector, which reflects light emitted from the light emitting element to a forward direction and which has a reflection surface having a section along a vertical plane containing the optical axis, the section formed of a parabolic shape having a focal point on the optical axis, wherein the plurality of light emitting chips are configured by a plurality of special light emitting chips which front end edges are aligned on a horizontal line orthogonal to the optical axis passing through the focal point of the parabolic section and at least one general light emitting chip disposed on a backward side from the plurality of special light emitting chips, and wherein light emitting chips in each of at least two sets of light emitting chips, each set being selected so as to include at least one special light emitting chip of the plurality of special light emitting chips, are simultaneously lighted in a lighting mode corresponding to the respective set.

2. A vehicular lamp unit according to claim 1, wherein a plurality of general light emitting chips are disposed in series in forward and backward directions of the lamp unit, and the lighting mode includes a first lighting mode in which at least two of the plurality of special light emitting chips are simultaneously lighted and a second lighting mode in which at least one of the plurality of special light emitting chips and the general light emitting chips are simultaneously lighted.

3. A vehicular lamp unit according to claim 1, wherein a plurality of general light emitting chips are disposed, the plurality of light emitting chips including the plurality of special light emitting chips and the plurality of general light emitting chips are disposed in a matrix arrangement, and the lighting mode includes a first lighting mode in which the plurality of special light emitting chips are simultaneously lighted and a second lighting mode in which at least one of the plurality of special light emitting chips and at least one of the plurality of general light emitting chips are simultaneously lighted.

4. A vehicular lamp unit according to claim 1, wherein the reflection surface of the reflector is configured by a parabolic cylindrical plane which has a parabolic vertical section and which extends extending in the horizontal direction orthogonal to the optical axis.

5. A vehicular lamp unit comprising:

a light emitting element, which is disposed on an optical axis extending in forward and backward directions of the lamp unit so as to be directed upward, and which has a plurality of light emitting chips mounted on a board and disposed with a predetermined arrangement so as to be adjacent to each other; and a reflector, which reflects light emitted from the light emitting element to a forward direction, and which has a reflection surface having a section along a vertical plane containing the optical axis, the section formed of a parabolic shape having a focal point on the optical axis, wherein the plurality of light emitting chips are configured by a plurality of special light emitting chips which rear end edges are aligned on a horizontal line orthogonal to the optical axis passing through the focal point of the parabolic section and at least one general light emitting chip disposed on a forward side from the plurality of special light emitting chips, and wherein light emitting chips in each of at least two sets of light emitting chips, each set being selected so as to include at least one special light emitting chip of the plurality of special light emitting chips, are simultaneously lighted in a lighting mode corresponding to the respective set.

6. A vehicular lamp unit according to claim 5, wherein a plurality of general light emitting chips are disposed in series in forward and backward directions of the lamp unit, and the lighting mode includes a first lighting mode in which at least two of the plurality of special light emitting chips are simultaneously lighted and a second lighting mode in which at least one of the plurality of special light emitting chips and the general light emitting chips are simultaneously lighted.

7. A vehicular lamp unit according to claim 5, wherein a plurality of general light emitting chips are disposed, the plurality of light emitting chips including the plurality of special light emitting chips and the plurality of general light emitting chips are disposed in a matrix arrangement, and the lighting mode includes a first lighting mode in which the plurality of special light emitting chips are simultaneously lighted and a second lighting mode in which at least one of the plurality of special light emitting chips and at least one of the plurality of general light emitting chips are simultaneously lighted.

8. A vehicular lamp unit according to claim 5, wherein the reflection surface of the reflector is configured by a parabolic cylindrical plane which has a parabolic vertical section and which extends extending in the horizontal direction orthogonal to the optical axis.

* * * * *